US009382701B2

(12) United States Patent
Meyers

(10) Patent No.: US 9,382,701 B2
(45) Date of Patent: Jul. 5, 2016

(54) LINEAR DRAIN ASSEMBLIES AND METHODS OF USE

(71) Applicant: Lawrence G. Meyers, Layton, UT (US)

(72) Inventor: Lawrence G. Meyers, Layton, UT (US)

( * ) Notice: Subject to any disclaimer, the term of this patent is extended or adjusted under 35 U.S.C. 154(b) by 0 days.

(21) Appl. No.: 14/626,581

(22) Filed: Feb. 19, 2015

(65) Prior Publication Data

US 2015/0240464 A1 Aug. 27, 2015

Related U.S. Application Data

(60) Provisional application No. 61/942,946, filed on Feb. 21, 2014.

(51) Int. Cl.

| | |
|---|---|
| ***E03C 1/22*** | (2006.01) |
| ***E03F 3/04*** | (2006.01) |
| ***E03F 5/04*** | (2006.01) |

(52) U.S. Cl.

CPC . *E03C 1/22* (2013.01); *E03F 3/046* (2013.01); *E03F 5/041* (2013.01); *E03F 5/0408* (2013.01)

(58) Field of Classification Search

CPC ..... E02D 31/02; E03C 1/22
USPC ..... 52/302.1, 302.3, 302.7, 12–14; 4/286, 4/289, 613; 210/163, 153, 164, 165, 247, 210/300

See application file for complete search history.

(56) References Cited

U.S. PATENT DOCUMENTS

| | | | |
|---|---|---|---|
| 855,017 | A | 5/1907 | O'Brien |
| 889,051 | A | 5/1908 | Schodde |
| 1,127,246 | A | 2/1915 | Hirshstein |
| 1,143,174 | A | 6/1915 | Comstock |
| 1,189,742 | A | 7/1916 | Sanders |
| 1,469,303 | A | 10/1923 | Hess |
| 1,669,586 | A | 5/1928 | Boosey |
| 1,749,878 | A | 3/1930 | Fleming |
| 1,792,345 | A | 2/1931 | Williams |
| 1,830,065 | A | 11/1931 | Luff |
| 2,095,024 | A | 10/1937 | Boosey |
| 2,394,964 | A | 2/1946 | Dick |
| 2,484,240 | A | 10/1949 | Morthland |
| 2,550,402 | A | 4/1951 | Boosey |
| 2,777,532 | A | 1/1957 | Sisk |
| 2,783,852 | A | 3/1957 | Sisk |
| 2,843,209 | A | 7/1958 | Degen |

(Continued)

FOREIGN PATENT DOCUMENTS

| | | | |
|---|---|---|---|
| EP | 2405062 A1 | 1/2012 | |
| EP | 2669442 A1 * | 4/2013 | ..... E03F 5/04 |

(Continued)

OTHER PUBLICATIONS

International Search Report and Written Opinion for PCT/US2015/016905 mailed on May 27, 2015.

(Continued)

*Primary Examiner* — Brent W Herring
(74) *Attorney, Agent, or Firm* — Workman Nydgegger

(57) ABSTRACT

A linear drain assembly includes a drain body with a drain channel extending along the drain body and an outlet structure intercepting the drain channel. The drain body has a constant outer profile along a longitudinal length of the drain body between at least one end of the drain channel and the outlet structure and the drain channel has a sloped bottom surface.

8 Claims, 14 Drawing Sheets

(56) References Cited

U.S. PATENT DOCUMENTS 2,859,452 A 11/1958 Seewack
2,898,129 A 8/1959 Sisk
2,981,333 A 4/1961 Miller
3,037,631 A 6/1962 Drehrnann
3,040,895 A 6/1962 Sisk
3,246,582 A 4/1966 Wade
3,742,525 A * 7/1973 Oropallo ..... E03C 1/22 4/288
4,052,227 A 10/1977 Delo
4,067,072 A 1/1978 Izzi
4,146,939 A 4/1979 Izzi
4,150,009 A 4/1979 Milenius
4,206,785 A * 6/1980 Graafmann ..... F16L 55/033 138/149
4,505,814 A 3/1985 Marshall
4,555,818 A 12/1985 Harrington
4,739,524 A 4/1988 Burd
4,845,914 A 7/1989 Burd
4,910,811 A 3/1990 Izzi
5,022,430 A 6/1991 Degooyer
5,130,016 A 7/1992 Gavin
5,137,314 A 8/1992 Gunter
5,216,767 A 6/1993 Elmore
5,245,800 A * 9/1993 Davenport ..... E04D 13/0641 52/11
5,293,724 A 3/1994 Cornwall
5,299,836 A 4/1994 Woods
5,372,715 A 12/1994 Maggard
5,437,138 A * 8/1995 Tuohey ..... E04D 13/064 248/48.2
5,491,998 A * 2/1996 Hansen ..... E04D 13/076 52/12
5,511,904 A 4/1996 Van Egmond
5,656,176 A 8/1997 Scott
5,845,435 A * 12/1998 Knudson ..... E04D 13/076 248/48.1
6,175,971 B1 1/2001 O'Neill
6,192,532 B1 2/2001 Sesser
6,349,506 B1 * 2/2002 Pace ..... E04D 13/076 52/11
6,381,775 B1 5/2002 Sondrup
6,530,722 B1 * 3/2003 Shaw ..... E03F 5/0404 210/164
6,612,780 B2 * 9/2003 Dahowski ..... E01C 11/227 210/64
6,877,471 B1 4/2005 Tanabe
6,890,427 B2 5/2005 Self
7,216,458 B2 * 5/2007 Taouil ..... E04D 13/0641 52/11
7,472,719 B2 1/2009 Dallmer
7,632,401 B2 12/2009 Edelmayer
7,699,981 B2 4/2010 Ledford
7,725,960 B2 6/2010 Markaj
7,967,523 B2 * 6/2011 Hetzler ..... E03F 3/046 404/2
8,043,497 B2 10/2011 Silverstein
8,146,616 B2 4/2012 Dallmer
8,181,288 B1 * 5/2012 Davis, Jr. ..... A47K 3/40 4/613
8,544,219 B1 * 10/2013 Janesky ..... E04B 1/7023 4/682
8,850,633 B2 * 10/2014 Erlebach ..... A47K 3/40 4/679
8,950,122 B2 * 2/2015 Degenhardt ..... E04D 13/076 52/12
2003/0159978 A1 8/2003 Self
2005/0016094 A1 * 1/2005 Ragsdill ..... E03F 5/0407 52/302.1
2005/0166467 A1 * 8/2005 Taouil ..... E04D 13/0641 52/13
2007/0209109 A1 9/2007 Meyers
2008/0005835 A1 1/2008 Shipley
2008/0271232 A1 11/2008 Self
2008/0277324 A1 11/2008 Meyers
2010/0043136 A1 2/2010 Michael
2010/0162481 A1 * 7/2010 Erlebach ..... E03F 5/04 4/613
2010/0235982 A1 9/2010 Stimpson
2010/0288685 A1 11/2010 Meyers
2010/0320130 A1 * 12/2010 Meyers ..... E03F 5/0409 210/164
2011/0047695 A1 3/2011 Niedens
2011/0067175 A1 * 3/2011 Steylaerts ..... E03F 5/0408 4/679
2011/0088161 A1 * 4/2011 Stimpson ..... A47K 3/40 4/613
2011/0162137 A1 * 7/2011 Kik, Sr. ..... E03F 3/046 4/613
2011/0303595 A1 * 12/2011 Larsson ..... E03F 5/0407 210/164
2012/0042579 A1 * 2/2012 McCoy ..... E04D 13/076 52/12
2012/0047643 A1 3/2012 Meyers
2012/0110827 A1 5/2012 Doolittle
2012/0124736 A1 * 5/2012 Davis, Jr. ..... A47K 3/40 4/613
2013/0276226 A1 * 10/2013 Cook ..... A47K 3/40 4/613
2014/0230140 A1 * 8/2014 Davis, Jr. ..... A47K 3/40 4/613
2014/0318030 A1 * 10/2014 Degenhardt ..... E04D 13/076 52/12

FOREIGN PATENT DOCUMENTS

JP 2010-169153 A * 8/2010 ..... F16L 55/02
WO 2013/037710 A1 3/2013
WO WO2013037710 3/2013

OTHER PUBLICATIONS

International Search Report for PCT/US2008/056731 mailed Jul. 17, 2008.
U.S. Appl. No. 12/046,352, Apr. 6, 2009, Office Action.
U.S. Appl. No. 11/716,851, Apr. 7, 2009, Office Action.
U.S. Appl. No. 11/716,851, Oct. 27, 2009, Final Office Action.
U.S. Appl. No. 12/046,352, Nov. 2, 2009, Final Office Action.
U.S. Appl. No. 12/862,681, Dec. 6, 2012, Office Action.
U.S. Appl. No. 12/862,689, Jan. 15, 2013, Office Action.
U.S. Appl. No. 12/772,220, May 28, 2013, Office Action.
U.S. Appl. No. 12/862,681, Jul. 23, 2013, Office Action.
U.S. Appl. No. 12/862,689, Aug. 14, 2013, Final Office Action.
U.S. Appl. No. 12/862,681, Sep. 18, 2013, Final Office Action.
U.S. Appl. No. 12/772,220, Nov. 27, 2013, Final Office Action.
U.S. Appl. No. 12/882,689, Dec. 4, 2013, Office Action.
U.S. Appl. No. 12/882,689, Jul. 29, 2014, Final Office Action.
U.S. Appl. No. 12/772,220, Nov. 10, 2014, Notice of Allowance.
U.S. Appl. No. 12/882,689, Dec. 16, 2014, Office Action.
PCT/US2015/016905 International Search Report and Written Opinion mailed May 27, 2015, 15 pages.
U.S. Appl. No. 12/862,689, May 19, 2015, Final Office Action.
U.S. Appl. No. 12/862,689, Jun. 24, 2015, Notice of Allowance.
U.S. Appl. No. 12/772,220, Jul. 17, 2015, Notice of Allowance.

* cited by examiner

LINEAR DRAIN ASSEMBLIES AND METHODS OF USE

CROSS-REFERENCE TO RELATED APPLICATIONS

The present application claims priority to and the benefit of U.S. Provisional Application 61/942,946 entitled "LINEAR DRAIN ASSEMBLIES AND METHODS OF USE" filed Feb. 21, 2014, the disclosure of which is incorporated herein by reference.

BACKGROUND

Floors of shower rooms, garages, driveways, etc., are today often equipped with trench drains for drainage therefrom. The floor must be installed with a slope toward the trench drain whereby water on the floor may flow toward and into the trench drain. The trench drain must similarly be sloped toward an opening so that water falling into the trench drain may travel to and flow out through the trench drain outlet.

Unfortunately, known trench drain systems tend to suffer from a number of drawbacks. For example, trench drains can be noisy. They are also difficult to clean and accurately position during an installation. Another drawback is that they can be difficult or impossible to fit correctly within a tiled area and cannot extend from wall to wall. This tends to result in compromised tile appearances and/or inadequate drainage, which in turn can create trip hazards and/or flooding. Further, other known drains (e.g., standard round or square drains) can suffer from many of the same or similar problems found in known trench drain systems, such as being too noisy and/or difficult to clean.

SUMMARY

One or more embodiments of the present disclosure include a linear drain assembly that includes a drain body with a sloped drain channel, intercepted by a drain outlet. The drain body has a constant outer profile along a longitudinal length of the body allowing the length of the drain assembly to be modified during installation.

The embodiments described herein may include an outlet structure that intercepts the drain channel and provides an outlet which may connect to a plumbing system. The outlet structure may include at least one flow structure positioned in the outlet structure. The flow structure may form a plurality of flow paths with the outlet structure to disperse the flow of a fluid therethrough and to increase the flow path of a fluid therethrough. The kinetic energy of the fluid may thereby be decreased in a more gradual manner and noise associated with the fluid draining through the outlet structure may be decreased.

The flow structure may include an escape path to allow the air or other gases in the outlet structure to vent during draining of a fluid therethrough to further reduce bubbling of the fluid and noise associated therewith. The flow structure may include an open-cell foam structure to dissipate kinetic energy of the fluid and to dampen the sound vibrations generated by the fluid flowing therethrough.

According to a variation, the flow structure may be positioned partially in the drain channel. The flow structure may also be positioned in a lower portion of the outlet structure. The flow structure may seal about an outer periphery of the flow structure.

According to another variation, the drain assembly may include a cover having a plurality of a longitudinal grooves and a mesh material attached over the grooves. The longitudinal grooves and mesh material may strengthen connections being the cover and one or more types of flooring that may be applied to the top of the drain assembly.

According to another variant, the drain assembly may include a removable cover that may allow access to the outlet structure to remove debris from the outlet structure after installation of the drain assembly.

Features from any of the disclosed embodiments may be used in combination with one another, without limitation. In addition, other features and advantages of the present disclosure will become apparent to those of ordinary skill in the art through consideration of the following detailed description and the accompanying drawings.

BRIEF DESCRIPTION OF THE DRAWINGS

The drawings illustrate several embodiments of the invention, wherein identical reference numerals refer to identical elements or features in different views or embodiments shown in the drawings.

DETAILED DESCRIPTION

Reference will now be made to the exemplary embodiments illustrated in the figures and appendix, wherein like structures will be provided with like references. Specific language will be used herein to describe the exemplary embodiments, nevertheless it will be understood that no limitation of the scope of the disclosure is thereby intended. It is also to be understood that while at least some of the drawings are diagrammatic and schematic representations of various embodiments of the disclosure and are not to be construed as limiting the present disclosure, at least some of the drawings may be drawn to scale. Alterations and further modifications of the features illustrated herein, and additional applications of the principles of the disclosure as illustrated herein are to be considered within the scope of the disclosure. Furthermore, various well-known aspects of fluid drain assemblies are not described herein in detail in order to avoid obscuring aspects of the example embodiments.

It will be appreciated that while the illustrated assembly can be used in showers, the present disclosure may also have application in other environments, such as, for example, pools, garages, kitchens, patios, decks, and/or other appropriate environments. Moreover, while water is referenced herein, it will be appreciated that the present disclosure may function with any appropriate liquids, gases, or other flowing materials.

Now turning to the FIGS. 1-23, specific examples of various linear drain assemblies will be described. It will be appreciated that the described and illustrated embodiments are merely exemplary and include various features and/or components that can be combined in different embodiments. Thus, no feature or component should be interpreted to require use with one or more other components of features.

Figure 1:
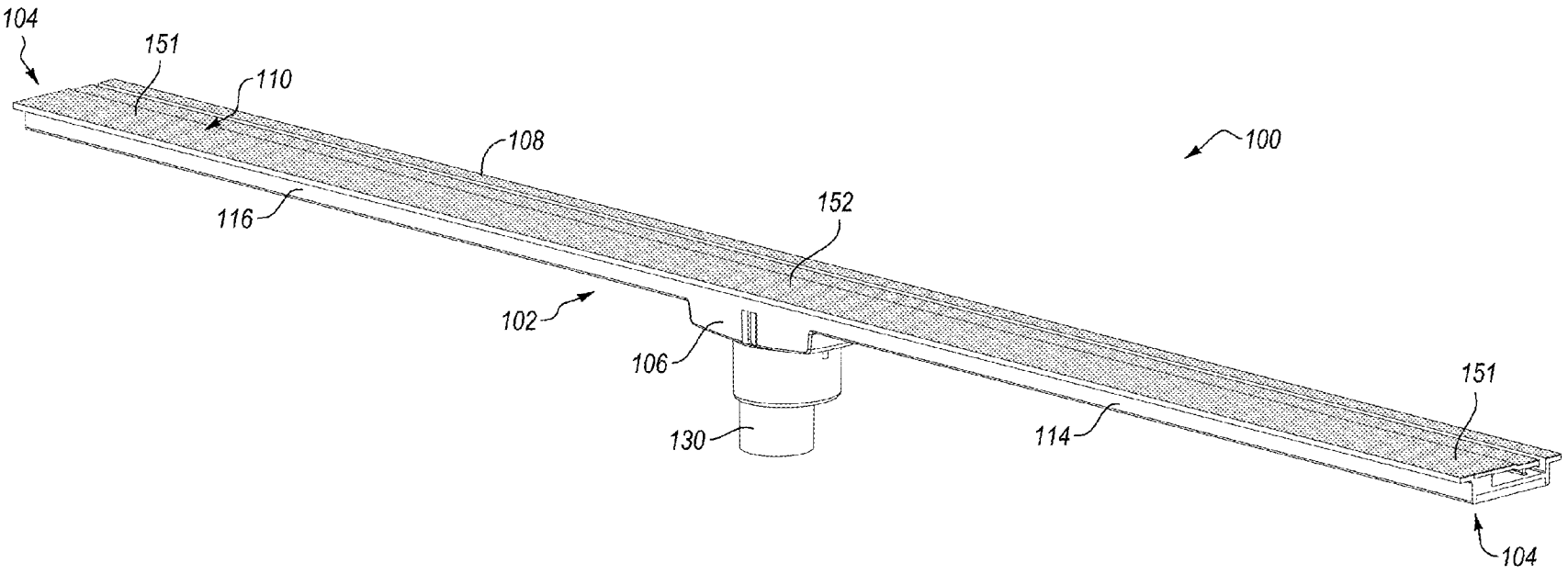
FIG. 1 is an isometric view of a linear drain assembly according to an embodiment.

As illustrated in FIG. 1, a linear drain assembly 100 can include at least one drain body 102 and at least one end attachment 104 that is selectively attachable to the drain body 102. The drain body 102 includes an outlet structure 106, an internal channel 108 (shown in FIG. 2) that intercepts the outlet structure 106, and a permanent structural cover 110 covering the internal channel 108 and the outlet structure 106. The cover 110 may define a slotted inlet 112 that extends longitudinally and is in fluid communication with the internal channel 108. The drain body 102 may also include a length extending between opposite longitudinal ends 151.

The drain body 102 between the outlet structure 106 and the longitudinal ends 151 of the drain body 102 can exhibit a U-shaped outer cross-section having a bottom surface 114 and side walls 116 extending generally upward from the bottom surface 114. The bottom surface 114 is opposite the cover 110 and the side walls 116 can extend longitudinally between the cover 110 and the bottom surface 114. The bottom surface 114 can be substantially flat. As seen in FIG. 1, a portion of the side walls 116 and bottom surface 114 can merge with and/or form a part of the outlet structure 106.

The outer cross-sectional profile of the drain body 102 remains constant from at least one end of the drain body 102 to the outlet structure 106 and the drain body 102 can be made from or include ABS (Acrylonitrile butadiene styrene), PVC (Poly Vinyl Chloride), or any other suitable material. This allows the length of the assembly 100 to be altered onsite by an installer using commonly available tools. For instance, the drain body 102 can be selectively shortened by way of field cutting thereby moving a first longitudinal end 151 from a first position to a second position, the second position being closer to the outlet structure 106. Because of the cutting of the drain body 102, the distance between the first longitudinal end 151 and the outlet structure 106 has shortened, and thus the first longitudinal end 151 has effectively moved from its original position. Because the outer cross-sectional profile of the drain body 102 is constant all the way from the first longitudinal end 151 to the outlet structure 106, the end attachments 104 can be located at any location between the first longitudinal end 151 and the outlet structure 106. The constant outer cross-sectional profile of the drain body 102 can be defined by one or more different portions of the drain body 102.

As described in more detail below, the end attachments 104 can be selectively attached to the outer surface of the drain body 102 at the longitudinal ends 151 and can exhibit any suitable configuration. Consequently, the assembly 100 can be cut to precise lengths and the end attachments 104 can be attached to almost any location where the drain body 102 is cut so that the assembly 100 can terminate at almost any point.

Figure 2:
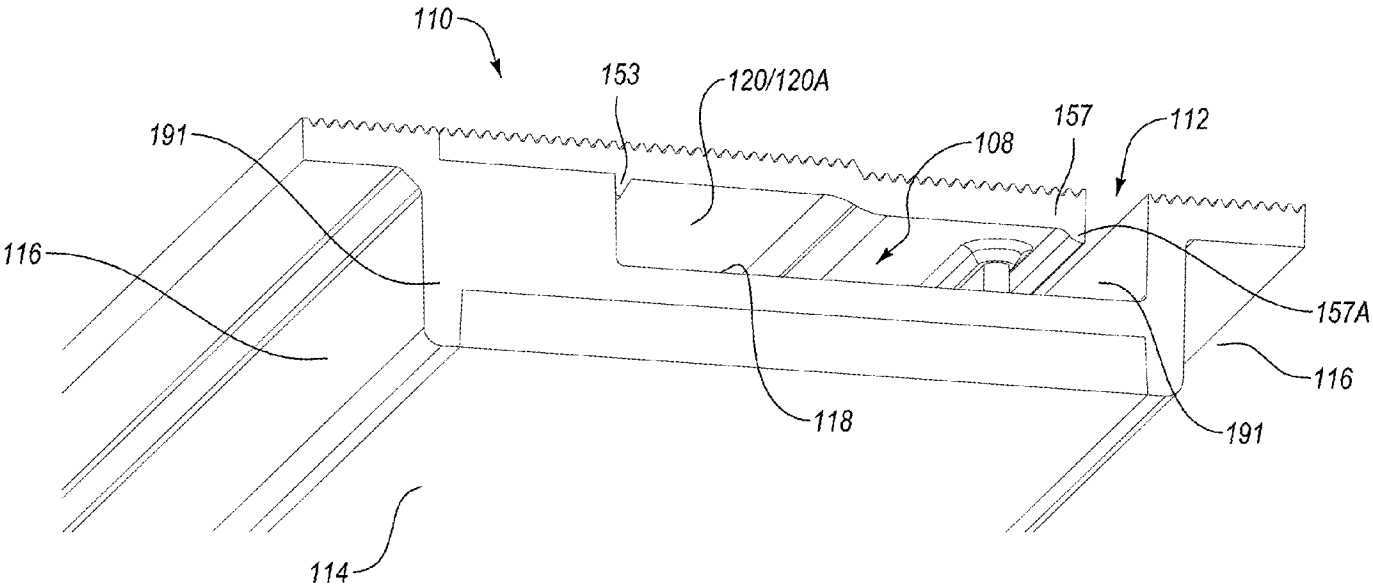
FIG. 2 is a cross-sectional view of the assembly shown in FIG. 1.

As shown in FIG. 2, the internal channel 108 can be concealed below the cover 110 and can include a generally rectangular cross-section having generally vertical side wall surfaces 191, a generally planar bottom surface 118 connecting and extending between the side wall surfaces 191 and an upper surface 120 defined by a bottom surface of the cover 110. One or more corners or transitions within the internal channel 108 can exhibit a radius of curvature 153 for reducing drag as water flows along or across the internal channels. This also can help prevent debris from becoming lodged in the transitions, making the internal channel 108 easier to clean. The upper surface 120 of the internal channel 108 may include one or more flow control features. For example, the upper surface 120 may include a recessed portion 120A extending longitudinally and forming a positive or uphill slope along the upper surface 120, and a drip edge 157A extending longitudinally and downward from the upper surface 120 along the slotted inlet 112. This has the effect of helping to prevent water from climbing along the upper surface 120 of the internal channel and/or directing water flowing into the slotted inlet 112 downward toward the bottom surface 118 of the internal channel 108. Alternatively, the internal channel 108 can have a U-shaped cross-section, a V-shaped cross-section, a trapezoidal cross-section, combinations thereof, or any other suitable cross-sectional shape.

Figure 3:
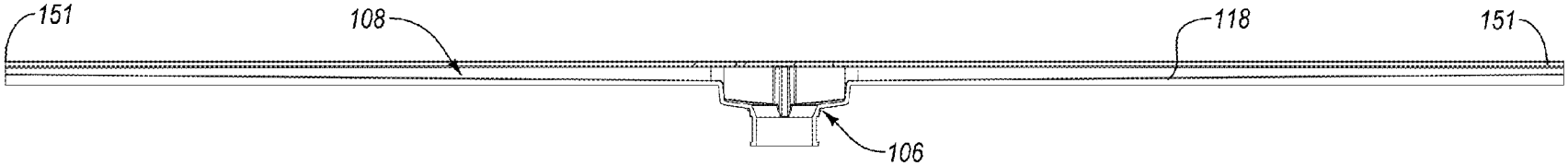
FIG. 3 is another cross-sectional view of the assembly shown in FIG. 1.

Referring now to FIG. 3, the internal channel 108 can extend in a longitudinal direction between the longitudinal ends 151 of the drain body 102, but for the break provided by the outlet structure 106. The bottom surface 118 of the internal channel 108 may be sloped downwardly running from the longitudinal ends 151 of the drain body 102 to the outlet structure 106. The internal channel 108 is thus in fluid communication with the outlet structure 106. The slope of the internal channel 108 causes water, for example, entering the internal channel 108 from the slotted inlet 112 (shown in FIG. 4) to flow under the force of gravity to the outlet structure 106. This provides a fluid flow path which causes water which enters the internal channel 108 to flow downwardly into the outlet structure 106, upon falling into the outlet structure 106, the water can flow through the outlet structure 106 into a drain pipe (not shown) or other appropriate underdrain structure. Alternatively, at least a portion of the bottom surface 118 of the internal channel 108 may be substantially flat.

The internal channel 108 may be sloped in other ways. In some embodiments, one or more wedge members can be adapted to be located on the bottom of the drain body 102 for thereby forming the flat bottom surface. The drain body 102 can include a constant thickness bottom wall forming both the bottom surface of the internal channel 108 and the bottom surface 114. The wedge member can include a terminal thick end tapering down to a terminal thin end, and a top inclined surface. The wedge member can be attached to the drain body 102 in any suitable manner. When positioned on the bottom of the drain body 102, the top inclined surface can abut the bottom of the drain body 102, the thin end can be positioned closest to the outlet structure 106 and the thick end positioned furthest from the outlet structure 106. Alternatively, the drain body 102 can include a bottom wall having a varying thickness to form the flat bottom surface 114 of the drain body 102. In other embodiments, the wedge member may be injection molded into the drain body between and/or in contact with the bottom surface 114 of the drain body 102 and the bottom surface of the internal channel 108.

Figure 4:
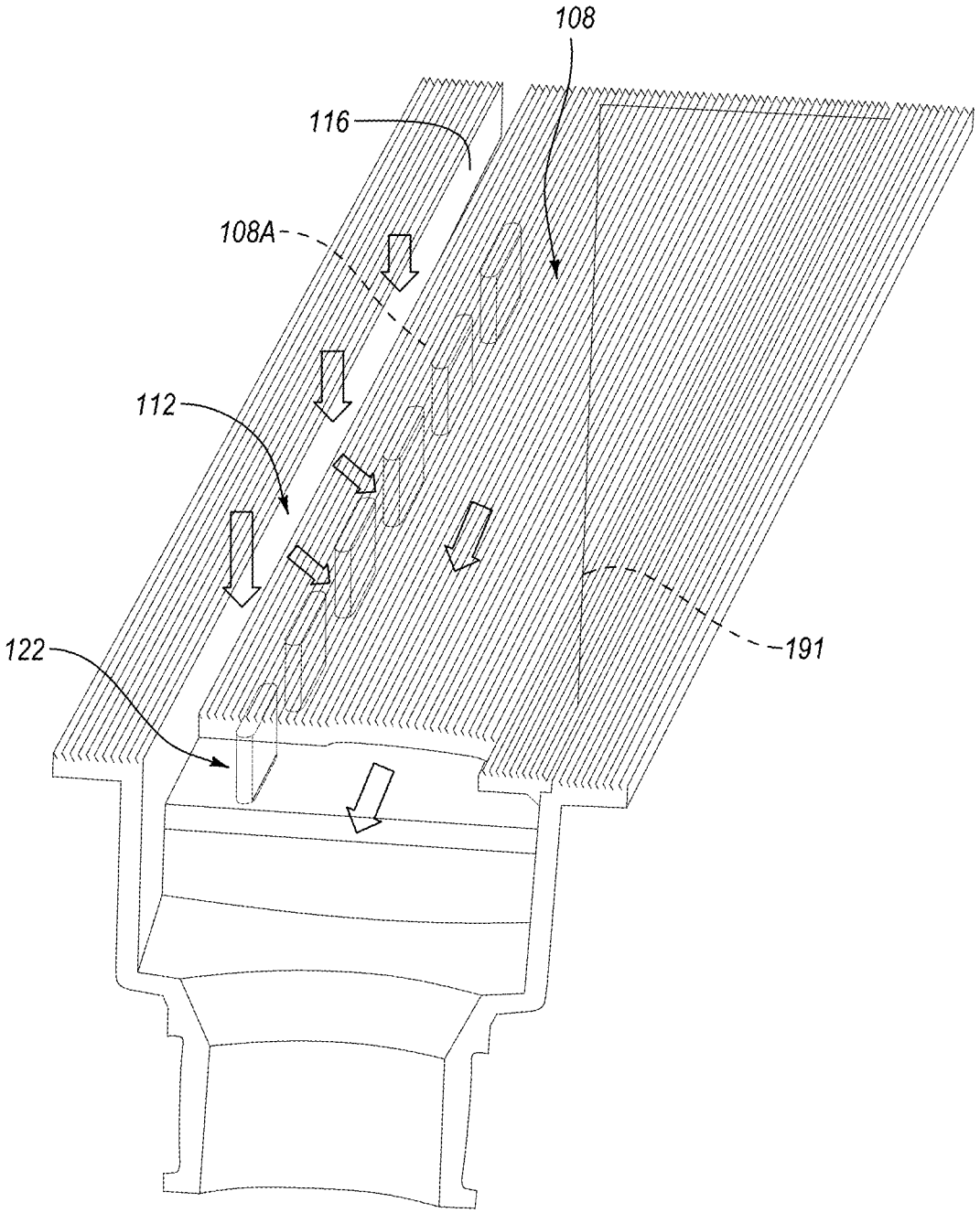
FIG. 4 is a partial cutaway view of the assembly shown in FIG. 1.

As shown in FIG. 4, the internal channel 108 may have a width defined between the side wall surfaces 116 that gradually increases towards the outlet structure 108. This is advantageous because the internal channel 108 may receive water through the slotted inlet 112 along substantially the entire length of the internal channel 108. Thus, the volume of water within the internal channel 108 can increase as it moves toward the outlet structure as more and more water is collected along the length of the internal channel 108. By gradually increasing the width of the internal channel 108 towards the outlet structure 106, the capacity of the internal channel 108 to carry the increasing volume of water increases. Such an increasing capacity helps to avoid flow capacity problems commonly found in conventional linear drains. In alternative embodiments, the internal channel 108 may be linear, curved, converging, diverging-converging, combinations thereof, or may define any suitable flow path.

The internal channel 108 may include different flow regions. For instance, the internal channel 108 may include an entrance flow region 108A and a main flow region 108B. The entrance flow region 108A may be located below the slotted inlet 112 and may extend between the side wall surface 191 along the slotted inlet 112 and a row of cover supports 122. The cover supports 122 are positioned and spaced apart within the internal channel 108. The cover supports 122 are internally connected to and support the cover 110 extending over the internal channel 108, which, in turn, eliminates the need for external fasteners and/or holes. The cover supports 122 may exhibit a long and narrow configuration. This has the effect of increasing the load distribution area between the cover 110 and the cover supports 122, which, in turn, can reduce stress concentrations within the cover 110.

The entrance flow region 108A may exhibit any suitable volume and/or area. For instance, to increase the volume of the entrance flow region 108A is desired, the cover supports 122 may be located closer to the side wall surface 191 further away from the slotted inlet 112. This may help increase the inlet capacity of the assembly 100. The main flow region 108B may be completely underneath the cover 110 and may extend between the side wall surface 191 and the cover supports 122. The bottom surface 118 within the entrance flow region 108A may include a portion sloping downward toward the main flow region 108B such that water entering the internal channel 108 through the slotted inlet 112 can be directed laterally from the entrance flow region 108A to the main flow region 108B. For instance, water entering the internal channel 108 through the slotted inlet 112 can travel along the entrance flow region 108A for a short distance and then move laterally through gaps present between the cover supports 122 to the main flow region 108B where a larger flow capacity may be present. This has the effect of moving water away from the slotted inlet 112, which, in turn, improves flow through the slotted inlet 112.

Figure 5:
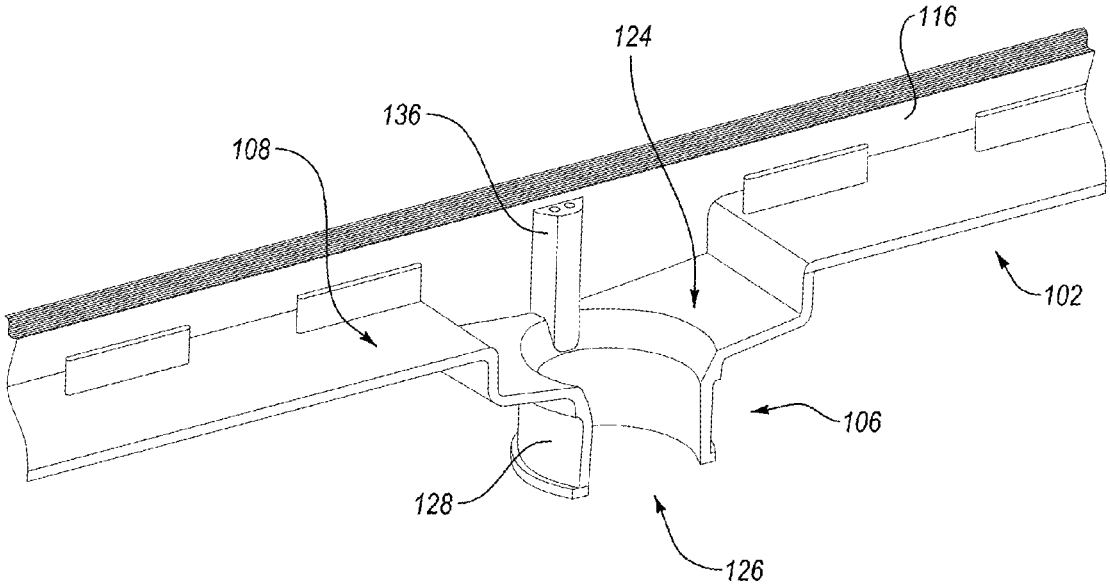
FIG. 5 is a partial cutaway view of the assembly shown in FIG. 1.

FIG. 5 illustrates the outlet structure 106 in more detail according to an embodiment. The outlet structure 106 is generally located at a center of the drain body 102, but can be placed at any point along the drain body 102 as long as the internal channel 108 directs water to the outlet structure 106. The outlet structure 106 can include a generally rectangular upper portion 124 in fluid communication with the internal channel 108. Alternatively, the upper portion 124 can have a cylindrical, trapezoidal, or any other suitable shape. The upper portion 124 can be substantially hollow and configured to provide a flow capacity large enough to collect water from the internal channel 108 without having the water overflow back into the internal channel 108. The transition between the internal channel 108 and the upper portion 124 of the outlet structure 106 can include a curve or radius for providing a smoother flow transition as water moves into the upper portion 124, which in turn, can decrease noise. Support columns 136 within the upper portion 124 can extend between the cover 110 and the outlet 126 described below. These support columns 136 connect to the cover 100 internally and are adapted to provide support to the cover 110 against loads that may be placed on the cover 110 extending over the upper portion 124. Alternatively, the upper portion 124 may be omitted. For instance, the internal channel 108 can be in direct fluid communication with the outlet 126 described above.

A cylindrical lower portion 128 can be in fluid communication with the upper portion 124 and define the outlet 126. In the illustrated embodiment, the outlet 126 extends downward from the drain body 102. Alternatively, the outlet 126 may extend sideways from at least one of the side walls 116 of the drain body 102. The outlet 126 may be generally square, generally elliptical, or may exhibit any suitable shape.

The outlet 126 can be configured to be directly or indirectly connected to a drain pipe or another underdrain structure in any suitable manner. For example, the outer radial surface of the lower portion 128 can include a circumferential recess for receiving a sealing member configured to provide a substantially watertight seal. The outlet 126 can be connected to a drain pipe via a sealing member interposed between an offset drain adaptor 130 (shown in FIGS. 1 and 6) and the outer radial surface of the lower portion 128. The sealing member can help form a water tight connection between the outlet 126 and a drain pipe or adaptor. Further, the sealing member can provide vertical adjustment capability to the assembly 100.

Figure 6:
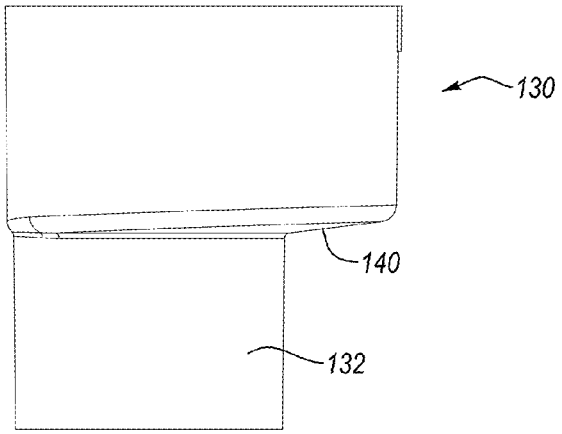
FIG. 6 is a front view of outlet adaptor according to an embodiment.

Referring now to FIG. 6, the drain adaptor 130 includes an outlet portion 132 that is offset from a central axis of the outlet 126. Rotation of the adaptor 130 allows an installer to adjust the position of the outlet 126 relative to the drain pipe. The adaptor 130 can be constructed of a polymer such as ABS or PVC, or steel, a nonflammable material, or any other appropriate material. The lower portion 128 can include helical threads for connection to a drain pipe or other underdrain structure allowing the height of the assembly 100 to be adjusted by rotating the drain adaptor 130. Alternatively, the lower portion 128 can be directly glued to the drain pipe and/or can include any suitable height adjustment mechanisms.

Figure 7:
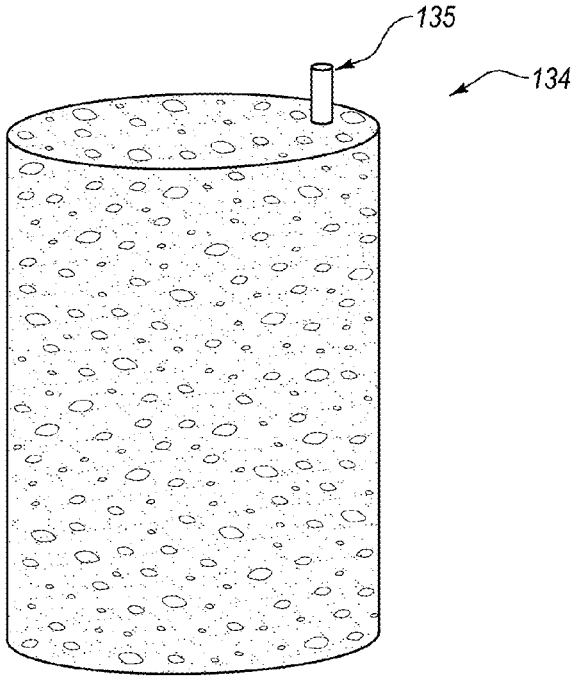
FIG. 7 is an isometric view of a flow structure according to an embodiment.

Referring to FIG. 7, at least one flow structure 134 is located within the outlet structure 106 to dissipate energy of the flowing water that is directed through the outlet structure 106. Dissipating energy in a controlled manner may reduce noise associated with the water draining through the drain assembly 100. The flow structure may form a plurality of indirect flow paths (i.e., flow paths which do not following the shortest path) within the outlet structure 106. The flow structure 134 can comprise a flow separator, a reticulated flow device, a flow control device, a flow diffuser, a flow and/or sound attenuator, a flow distributor, combinations thereof, or any other appropriate structure or member that can form or provide a plurality of indirect flow paths within the outlet structure 106. At least one of the indirect flow paths may comprise a random path, a roundabout path, a reticulated path, a circuitous path, a wandering path, a tortuous path, a zigzagging path, combinations thereof, or any other appropriate indirect path.

In use, the flow structure 134 can disperse the flow of water through the different indirect flow paths and can lengthen the flow time to the drain pipe rather than having the water flow straight down the side walls of the outlet, as in conventional drains. This has the effect of reducing the noise and/or kinetic energy associated with the flowing water. In some embodiments, the flow structure 134 can be bidirectional allowing flow to pass through the flow structure 134 in at least two directions. For instance, the flow structure 134 also can provide escape paths 135, such as a substantially vertical tube or other fluid channel extending above an upper surface of the flow structure 134, for air or other gases located in the bottom of the outlet 126 to escape from the outlet 126 ahead of the discharging water, which, in turn, reduces gurgling within the outlet structure 106. Alternatively, the flow structure 134 can be a one-way flow device allowing flow to pass through the flow structure 134 in only one direction.

The flow structure 134 can also absorb or dampen sounds or vibrations traveling through the drain body 102 that may otherwise be amplified by trench drains and/or standard drains (e.g., round or square drains). For instance, lids or covers on known trench drains tend to create a resonance chamber within the drain that amplifies noises or sounds. Further, standard drains with a significant drop or vertical span between the inlet and outlet can form a similar sound amplifying chamber. By positioning the flow structure 134 within the outlet structure 106, the flow structure 134 can absorb vibrations/sounds traveling within the outlet structure 106 and/or drain body 102, thereby dampening and/or preventing amplification of vibrations/sounds in the assembly 100. This advantageously makes the assembly 100 quieter. In addition to reducing noise, the flow structure 134 can catch debris that is too large to pass through the indirect flow paths of the flow structure 134.

As shown, the at least one flow structure 134 can comprise an open-celled, rod-like foam member 134 positioned in the outlet 126 (shown in FIG. 5). The bottom of the flow structure 134 can cover the outlet portion 132 of the adaptor and can be positioned on an internal support surface 140 formed within the adaptor 130 (shown in FIG. 6). Because the outlet portion 132 is offset within the adaptor 130, when the flow structure 134 is pushed down, it will encounter the internal support surface 140 and not pass through the outlet portion 132 into the drain pipe or other underdrain structure.

The flow structure 134 can have a height, width, and/or porosity configured to selectively fit and/or function within the outlet structure 106. For instance, the flow structure 134 may exhibit a specific porosity such that flow area through the outlet 126 meets the requirements of certain plumbing codes and/or regulations when the flow structure 134 is positioned within the outlet structure 106. The flow structure 134 may have a height that is less than the height of the outlet structure 106 or the flow structure 134 may have a height that is more than the height of the outlet structure 106. For instance, the flow structure 134 may have a height that extends between about the internal support surface 140 and the bottom surface of the cover 110. The flow structure 134 can be formed of a polymeric material (e.g., ABS or PVC) or any other suitable material.

The flow structure 134 may be sized such that a gap is formed between the inner surface of the outlet 126 and the outer surface of the flow structure 134. As such, debris can be caught on the outer surface of the flow structure 134 and can build up from the support surface 140 within the adaptor 130 in the gap. This advantageously provides a convenient area for such debris to collect and/or to be cleaned out. While the flow structure 134 is described as a rod-like foam member, it will be appreciated that the flow structure can comprise any appropriate structure. For instance, the flow structure 134 can comprise a compressible permeable member. The flow structure 134 can comprise a permeable, flexible, open-celled foam or sponge member.

Figure 8:
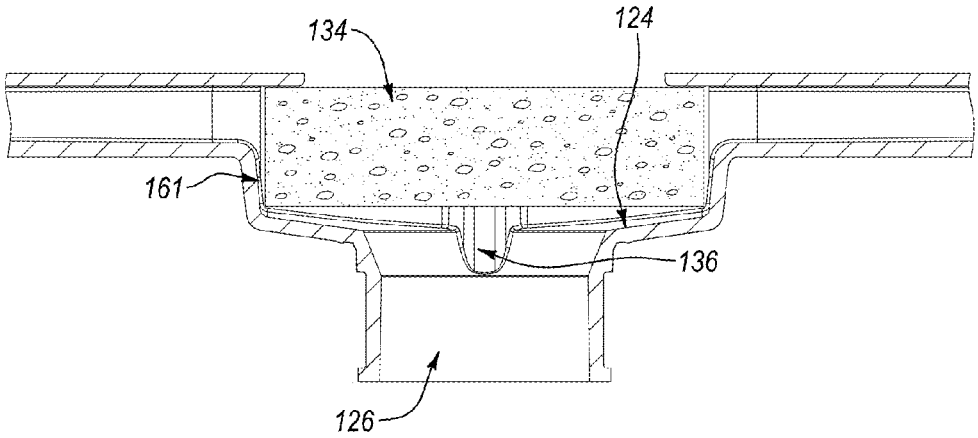
FIG. 8 is a partial cutaway view of the assembly shown in FIG. 1 showing a flow structure according to another embodiment.

As seen in FIG. 8, the flow structure 134 can comprise a generally rectangular open celled structure 134 positioned within the upper portion 124 of the outlet structure 106. The support columns 136 within the upper portion 124 can help position the flow structure 134 within the upper portion 124 by holding the flow structure 134 between the support columns 136. The support columns 136 can also help maintain gaps 161 between the outer surface of the flow structure 134 and the inner surface of the upper portion 124. The gaps 161 may have a width between about 0.1 inches and about 2 inches, about 0.2 inches and about 1.5 inches, about 0.3 inches and about 1 inch, or about 0.4 inches and about 0.6 inches. In other embodiments, the gaps may be larger or smaller. As noted above, this advantageously provides a convenient area for debris to collect and/or to be cleaned out.

In some embodiments, the flow structure 134 can comprise a first flow structure and a second flow structure. The first flow structure can be positioned in the upper portion 124 and the second flow structure can be positioned in the outlet 126. The first and second flow structures may be substantially similar. Alternatively, the first and second flow structures may be different. For instance, the first flow structure can have flow paths that are wider than the flow paths of the second flow structure. The first flow structure can have flow paths that are offset from the flow paths of the second flow structure.

Figure 9:
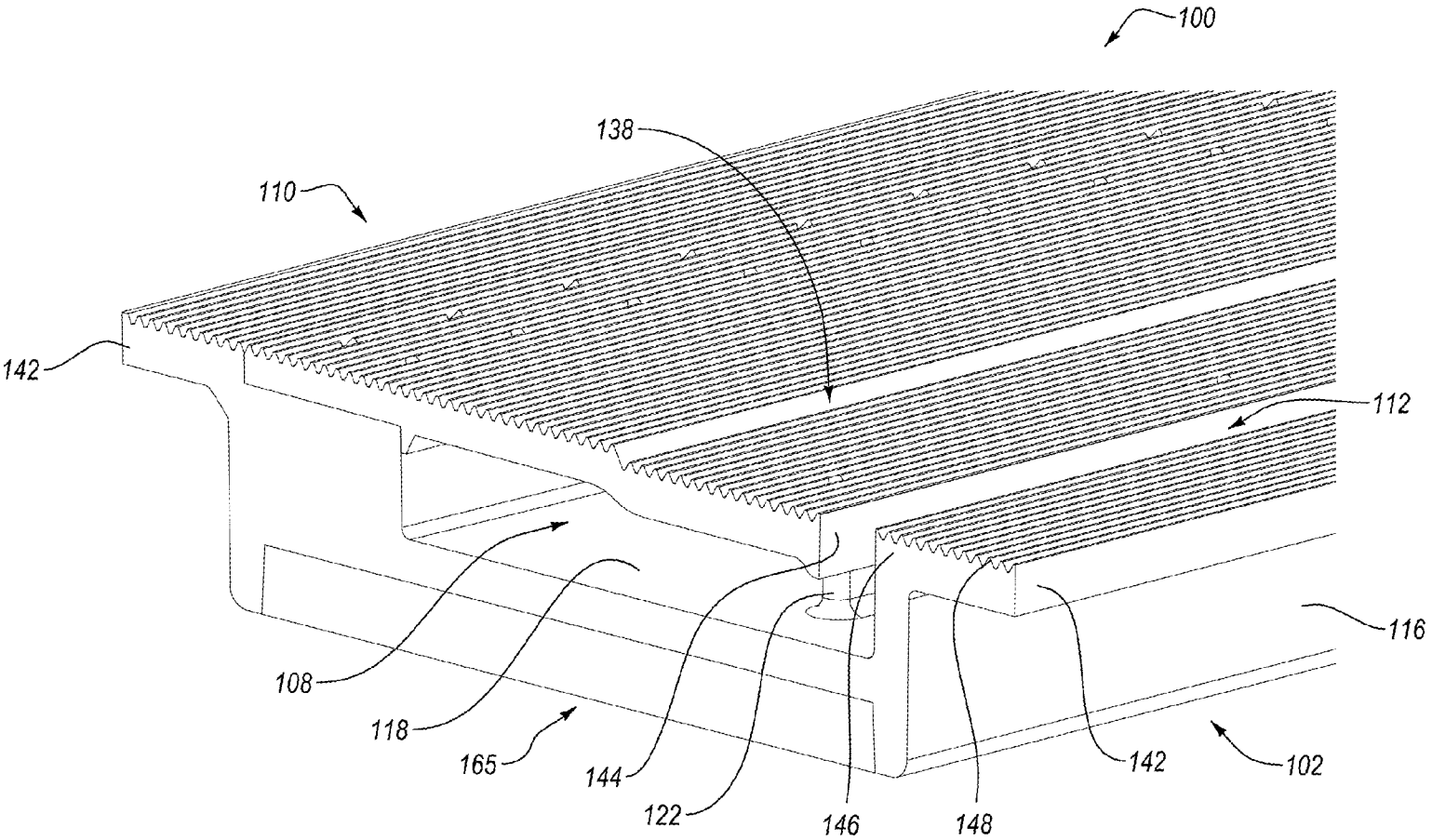
FIG. 9 is a detailed view of the assembly shown in FIG. 1.

FIG. 9 illustrates the structure of the cover 110 in more detail. The cover 110 defines a top surface of the assembly 100. With the exception of the slotted inlet 112, the cover 110 can be covered with tile, stone, concrete, stucco, or other floor covering so that the cover 110 will blend into the flooring material surrounding the assembly 100. The cover 110 extends between the side walls 116 of the drain body 102 and can define flanges 142 extending horizontally from the top of the side walls 116. The cover 110 can be connected to the drain body 102 in any suitable manner. The cover 110 can be supported internally by the drain body 102. For instance, the cover 110 can be internally connected to and at least partially supported by the cover supports 122 and the support columns 136 (shown in FIG. 5) within the drain body 102. This has the effect of eliminating the need for external mechanical fasteners and holes formed in the drain body 102, which, in turn, allows the outer cross-sectional profile of the drain body 102 to remain free of such obstructions and/or variations from the longitudinal ends 151 of the drain body 102 to the outlet structure 106. The cover 110 may further include a small overhang or cantilever 157 (shown best in FIG. 2) extending between the cover supports 122 and the front inside wall 144 of the slotted inlet 112.

The slotted inlet 112 permits water to be drained into the internal channel 108 and can extend along the entire length of the cover 110, including through the longitudinal ends 151 of the drain body 102. The slotted inlet 112 can be defined by a front inside wall 144 that extends from the top surface of the cover 110 to the bottom surface of the cover 110, and a back inside wall 146 that extends from the top surface of the cover 110 to the bottom surface 118 of the internal channel 108. The width of the slotted inlet 112 can be a fixed dimension. The slotted inlet 112 may be located toward one side of the cover along the side wall 191 of the internal channel 108. Alternatively, the slotted inlet 112 may extend along a longitudinal center of the cover 110. The slotted inlet 112 may be located in any suitable location where it is in fluid communication with the internal channel 108. While one slotted inlet 112 is described, it will be appreciated that the cover 110 can include a plurality of slotted inlets 112 and that different inlets 112 may be different in length, location, and/or width.

The width of the slotted inlet 112 can be varied according to the needs of a particular application, and may generally depend on the peak volume of water that is anticipated to be drained through the assembly 100. The width of the slotted inlet 112 may be between about 0.1 inches and about 0.5 inches, about 0.125 inches and about 0.25 inches, or about 0.15 inches and about 0.20 inches. Such widths advantageously may appear as a simple gap between tiles, making the assembly 100 substantially invisible. Alternatively, the width of the slotted inlet 112 may be larger or smaller.

The top surface of the cover 110 can include at least one tile trim seat 138 for receiving and positioning a tile trim 162. The tile trim seat 138 can comprise a shallow recessed surface formed in the top surface of the cover 110. The tile trim seat 138 can extend between the longitudinal ends 151 of the cover 110.

The top surface of the cover 110 can be wide in a transverse direction and thin in a vertical direction. This advantageously allows a tileable or other flooring surface extending over the cover 110 to be sloped toward the slotted inlet 112. For instance, the top surface of the cover 110 can include a transverse slope that directs water flowing across a tile floor on the cover 110 into the slotted inlet 112. The cover 110 can have an asymmetrical transverse cross-sectional shape including a high side and low side that slopes from the high side down to the slotted inlet 112. The top surface of the cover 110 can include one or more stepped surfaces extending between the longitudinal ends 151 of the cover 110. As such, a tile positioned on the cover 110 may be pitched on the stepped surfaces toward the slotted inlet 112.

The top surface of the cover 110 can be bondable and/or sealable for waterproofing. The top surface of the cover 110 can include a plurality of grooves 148 formed therein. One or more of the grooves 148 can have a V-like cross-sectional shape. One or more of the grooves 148 can have a U-like cross-sectional shape, a trapezoidal cross-sectional shape, or any other suitable cross-sectional shape. This has the effect of creating a larger bonding area on the top surface of the cover 110 and allows the top surface to better capture mortar, bonding agents, sealants, and/or adhesives that may be used to bond a tileable or other flooring surface to the cover 110. Further, this provides the top surface of the cover 110 with more versatility to bond with a variety of different materials. For instance, the top surface of the cover 110 can bond with a number of different waterproofing systems, including, but not limited to, fabric membranes and/or liquid applied membranes. Alternatively, one or more of the grooves 148 can be linear, curved, multi-directional, combinations thereof, or the like. The grooves 148 can extend longitudinally between the longitudinal ends 151 of the drain body 102. This advantageously can allow the grooves 148 to form a plurality of flow barriers to restrict water from weeping across the top surface of the cover 110.

Figure 10:
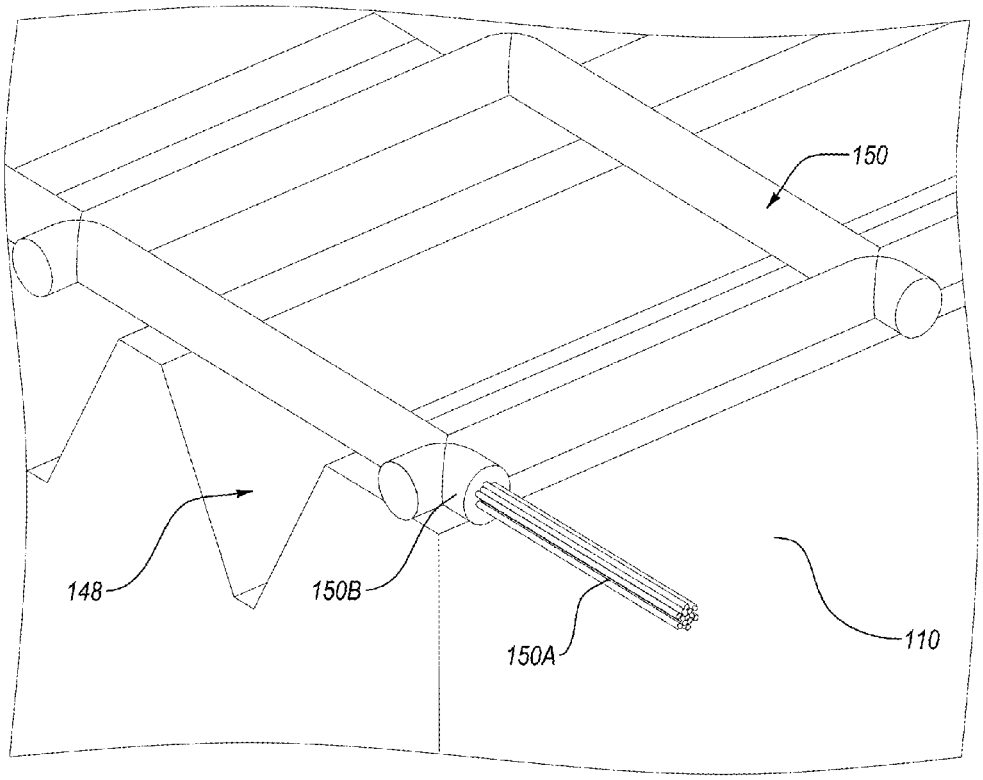
FIG. 10 is a detailed view of the top surface of the cover shown in FIG. 1 according to another embodiment.

As shown in FIG. 10, the top surface of the cover 110 may also be configured to form a three-dimensional lock to further capture bonding or other materials for waterproofing and/or bonding. In some embodiments, a three-dimensional structure encapsulated in ABS can be attached to the top surface of the cover 110. For instance, an encapsulated mesh material 150 may be attached to the top surface of the cover 110 that spans over the grooves 148. The mesh material 150 and the cover 110 can both be made of ABS material such that coverage of the mesh material 150 over the top surface of the cover 110 is substantially consistent and free of obstructions that could make cutting the assembly 100 more difficult. The mesh material 150 can be attached to the top surface of the cover 110 in any suitable manner. The mesh material 150 can comprise fiberglass fibers 150A encapsulated in ABS 150B. For instance, the mesh material 150 can be placed in a bath where it is encapsulated in an ABS plastisol or a suspension of ABS particles in a liquid plasticizer. The encapsulated mesh material 150 is then removed from the bath and held against the top surface of the cover portion 110 until the encapsulated mesh material 150 flashes off (e.g., the solvent, such as methylethylketone ("MEK"), evaporates off and leaves the resin behind). This technique can create an ABS bond or structure that is much more homogenous than a PVC bond or other type of plastic bond, which initially bonds and then eventually fails.

This can create a resultant structure of ABS encapsulated fibers in a box weave or grid pattern that effectively puts a lid over the grooves 148. For instance, when a sealant is applied to the top surface of the cover 110, the sealant can extrude down into the holes in the mesh material 150 and can be captured between the mesh material 150 and the grooves 148 to form a water tight seal or a substantially water tight seal. Mortar can also be captured between the mesh material 150 and the grooves 148. Alternatively, other materials may be used to form the three-dimensional lock.

Figure 11:
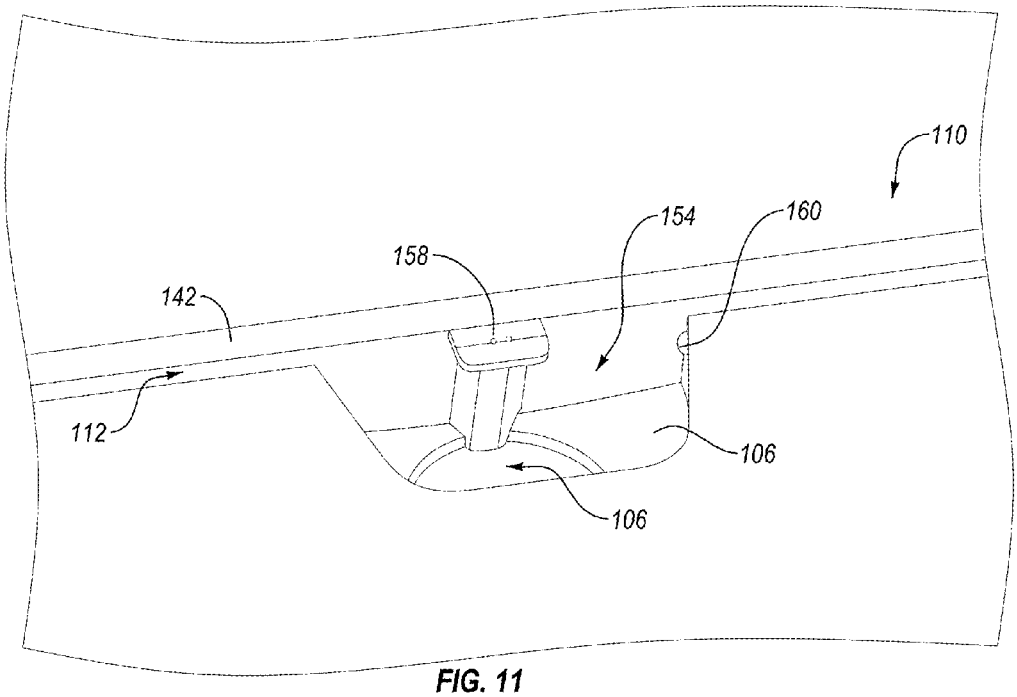
FIG. 11-12 illustrate steps for installing a removable panel of the assembly shown in FIG. 1.
Figure 12:
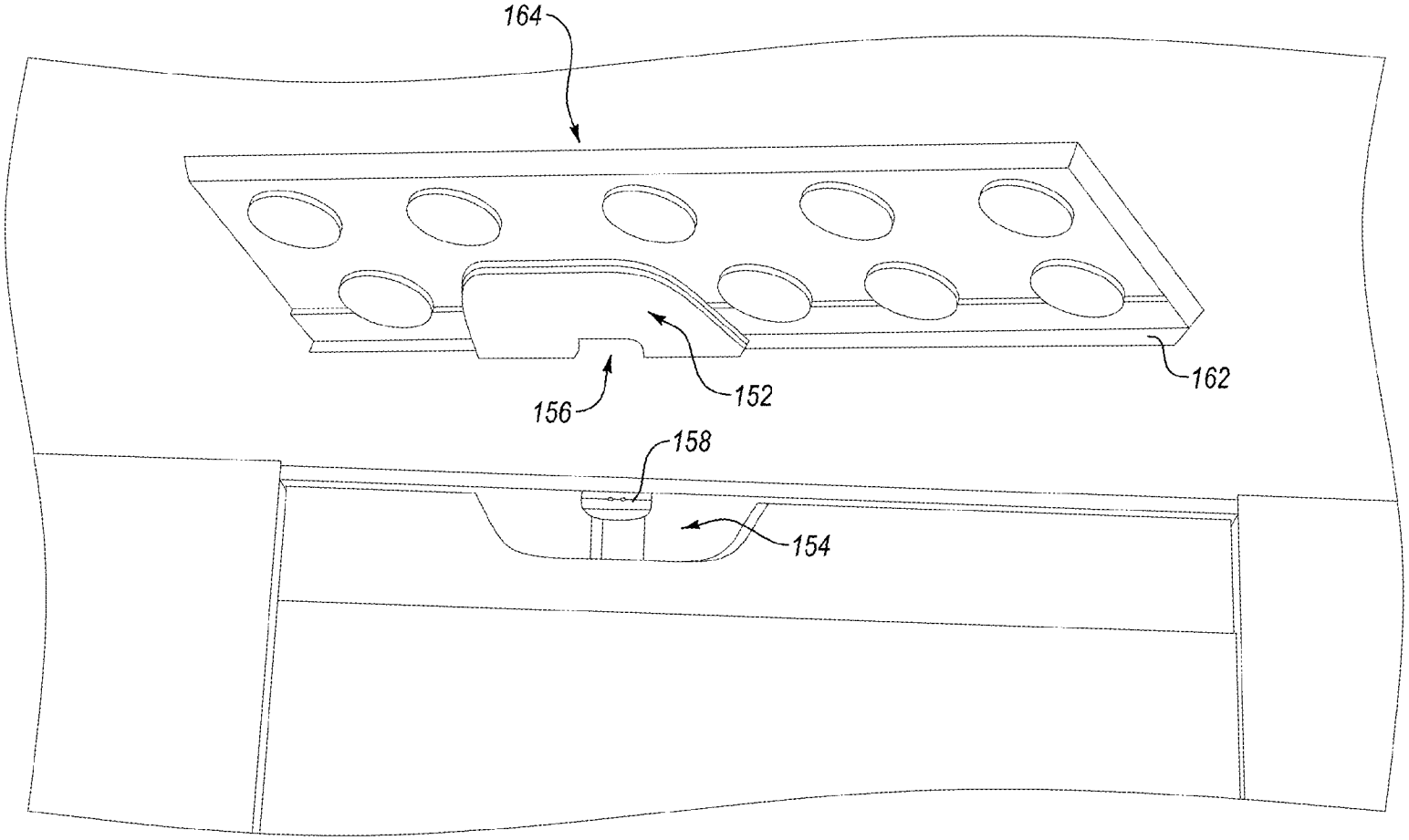

Referring to FIGS. 11 and 12, the assembly 100 includes a removable panel 152 disposed in the cover 110 over which tile or other flooring may be installed. For instance, the removable panel 152 (shown in FIGS. 1 and 12) corresponds to an access hole 154 formed in the cover 110 over the outlet structure 106. The removable panel 152 can exhibit a shape that generally corresponds to the access hole 154. The removable panel 152 can have a generally rounded trapezoidal shape including a longitudinal edge forming a portion of the front inside wall 144 of the slotted inlet 112. The removable panel 152 can have a generally rectangular shape, a generally elliptical shape, or any other suitable shape that generally corresponds to the shape of the access hole 154.

The removable panel 152 and the access hole 154 are sized and configured to provide adequate access to the outlet structure 106, but small enough such that removal of the removable panel 152 is not overly cumbersome. This has the effect of avoiding the excessive weight and difficulty associated with removing known long linear drain covers. In some embodiments, the removable panel 152 and the access hole 154 may be sized and configured to allow a flow structure 134 to be removed through the access hole. Removal of the flow structure 134 through the access hole 154 may ease cleaning of both the flow structure 134 and the outlet structure 106.

The removable panel 152 can include a cutout 156 (shown in FIG. 12) and the access hole 154 can include a protrusion or alignment tab 158 generally corresponding to the cutout 156 that is configured to be positioned within the cutout 156.

This advantageously allows the removable panel 152 to be quickly and automatically positioned within the access hole 154. The access hole 154 can include a plurality of temporary support tabs 160 protruding into the access hole 154. The support tabs 160 can support the removable panel 152 within the access hole 154 before the removable panel 152 is attached to a tile. The support tabs 160 can be removed after the assembly 100 is installed. In another embodiment, the support tabs 160 may be omitted, for example that lateral surface of the access hole 154 may be angled to support the removable panel 152.

The removable panel 152 can be installed within a tile floor in any suitable manner. For instance, a waterproof wall panel may be installed over studs and sealed on bottom to the top surface of the cover 110 on the flange 142 adjacent the slotted inlet 112. A mortar bed can be installed up to the top surface of the flange 142 opposite the slotted inlet 112 to form the appropriate slope towards the assembly 100. Thinset mortar can be spread over the top surface of the cover 110 and mortar bed.

A waterproofing membrane, which may be supplied by others, may be installed into the wet thinset mortar. As shown in FIG. 12, an access tile 164 can include three edges relief cut (e.g., beveled edges or otherwise have material removed therefrom). A tile trim 162 (e.g., a metal edge) can be cut to fit and epoxy bonded to the bottom surface of the access tile 164. A clearance cut can be formed in the tile trim 162 substantially aligned with the alignment tab 158. A release coating can be applied to all edges of the access tile 164 and to the back surface of the tile trim 162.

Next, a sanitary epoxy coating and a release coat can be applied to the exposed waterproof membrane area on the cover 110. The removable panel 152 is then set in position within the access hole 154 and a first amount of epoxy can be applied to the top surface of the access hole 154. Several more amounts of epoxy are then set onto the release coated surface. The access tile 164 is then set in place over the removable panel 152 and the epoxy is allowed to set, bonding it to the removable panel 152 and providing support over the back of the tile surface that will strengthen the access tile 164 and prevent it from rocking when stepped on. The removable panel 152 with the access tile 164 is removed and then replaced for grouting. The removable panel 152 can act as a guide and can locate the access tile 164 to the proper position and gives a professional finished appearance. Note, that the access opening 154 does not have to be centered on the access tile 164 but can offer a wide range of acceptable locations within the tile footprint. Finally, epoxy or urethane grout can be installed into all floor and wall joints as customary. The removable panel 152 is removed after the grout has set. The relief cuts on the edges of the access tile 164 can shape the grout at a generous or large angle. This advantageously provides strong grout edges that support the tile edges and are strong enough to not chip out with repeated use. When finished, the top surface of the access tile 164 can be located at substantially the same height as the surrounding floor. This allows the removable panel 152 to be virtually invisible in the tiled floor, providing simple and discrete access to the outlet structure 106 for cleaning and/or maintenance.

It will be appreciated that the removable panel 152 and/or the access tile 164 can be installed using a number of different techniques. Further, the access tile 164 can comprise a plurality of members. For instance, the access tile 164 can comprise a portion of a larger tile that has been cut out, for example, with a water jet. This can create an outer piece and inner piece that fits within the outer piece.

Figure 13:
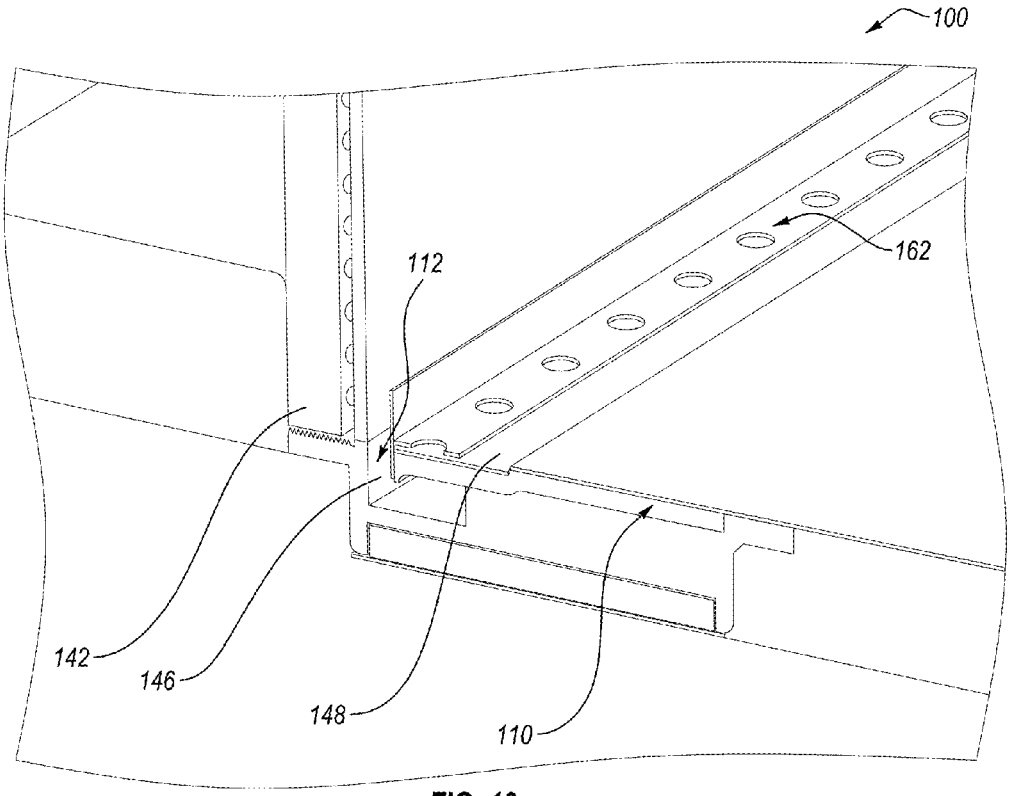
FIG. 13 illustrates installing the assembly shown in FIG. 1 according to an embodiment.

The low-profile, bondable configuration of the cover 110 can allow the assembly 100 to be easily positioned relative to a wall, a floor, or any other position that installation requires. FIG. 13 illustrates one exemplary installation process related to installing the assembly 100 along a tiled wall. The assembly 100 can be placed in position relative to a subfloor, which can be plywood or concrete. In placing the assembly 100 in position, the outlet structure 106 can be attached to a drain pipe or other underdrain structure. A waterproof panel (e.g., a waterproof tile backer) may be installed over studs and sealed on bottom to the top surface of the cover 110 on the flange 142 adjacent the slotted inlet 112. A mortar bed can be installed up to the top surface of the flange 142 opposite the slotted inlet 112 to form the appropriate slope towards the slotted inlet 112 of the assembly 100. It will be appreciated that a mortar bed is exemplary only, and other possible beds are possible. For example, a prefabricated shower bed or other hand-made shower pan can be installed up to the top surface of the flange 142. Thinset mortar can be spread over the top of the waterproof panel and wall tile can be set in the thinset mortar. This advantageously allows the face of the wall tile to be flush or substantially flush with the back inside wall 146 of the slotted inlet 112.

As shown in FIG. 13, a waterproofing membrane can be glued or sealed over the mortar bed and the cover 110, leaving the slotted inlet 112 open. Optionally, the waterproofing membrane can be a coating which is painted on. A tile trim 162 can be cut be cut and epoxy bonded to the top surface of the waterproofing membrane. The tile trim 162 can be positioned in the tile trim seat 138 on the top surface of the cover 110. Thinset mortar can be spread over the top of the waterproofing membrane on the floor. Finally, the floor tile is then set over the cover 110 of the assembly 100.

As shown in FIG. 13, the low-profile, bondable configuration of the assembly 100, allows the back inside wall 146 of the slotted inlet 112 to be installed coplanar or substantially coplanar with the face of the wall tiles. This advantageously allows the slotted inlet 112 to capture water at the transition between the wall and floor. Many showers are designed so that water sprayed from the shower head hit the back wall of the shower and flows down to the shower floor, where it then travels toward the drain. In such a design, the majority of water flow is concentrated at the transition between the wall and floor. Because the slotted inlet 112 can be positioned along this transition, the assembly 100 can capture all or most of the water before it gets out of the shower into the surrounding room, which, in turn, reduces the risk of flooding or other water damage. This is especially advantageous, in curbless, barrier free, and/or ADA showers. Moreover, this is accomplished with little or minimal alteration to the floor or wall structures.

Figure 14:
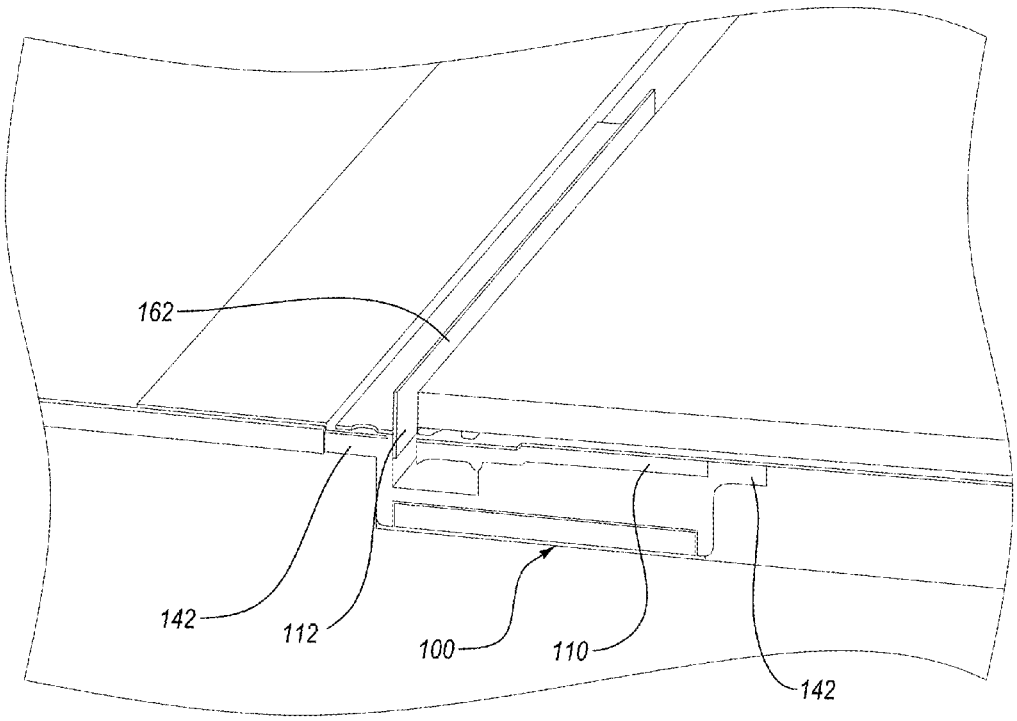
FIG. 14 illustrates installing the assembly shown in FIG. 1 according to another embodiment.

FIG. 14 illustrates one exemplary installation process related to installing the assembly 100 in the center of a tile floor. The assembly 100 can be placed in position relative to a subfloor, which can be plywood or concrete. In placing the assembly 100 in position, the outlet structure can be attached to a drain pipe or other underdrain structure. A waterproof panel may be installed over the subfloor and sealed to the back longitudinal edge of the flange 142 adjacent the slotted inlet 112. A mortar bed can be installed up to the top surface of the flange 142 opposite the slotted inlet 112 to form the appropriate slope towards the assembly 100. A waterproof membrane can be glued or sealed over the cover 110 and a portion of the waterproof panel, leaving the slotted inlet 112 open. Tile trim edges 162 can be epoxy bonded to the top surface of the waterproof membrane along both sides of the slotted inlet 112. Floor tile can then be attached to the waterproof membrane over the cover 110.

In some embodiments, thinset mortar can be spread over the top of the waterproof membrane and floor tile can be set in the thinset mortar over the flange 142 adjacent the slotted inlet 112. The wide and thin configuration of the assembly 100 allows the assembly 100 be virtually invisible in the tiled floor. This technique advantageously also produces a minimal visual impact, even though the slotted inlet 112 remains visible. For example, the gap between the opposing tile trim edges 162 can be less than about 0.3 inches, about 0.25 inches, or about 0.20 inches. It will be appreciated that the gap can also be larger or smaller and this installation process is exemplary only.

As described herein, the bottom surface 114 of the drain body 102 between the ends and the outlet structure 106 can be substantially flat. This advantageously allows for direct attachment of the assembly 100 to a subfloor (e.g., a wood or concrete subfloor) without the need for leveling mechanisms or shims or jacks. The substantially flat bottom surface 114 can be formed by added material to the bottom of the drain body 102.

Referring now to FIG. 1, the end attachments 104 are adapted to slidably attach to the outer cross-section profile of the longitudinal ends 151 of the drain body 102. For instance, coupling members 104A may be used for adjoining an extension to the drain body 102, floor terminations 104C (shown in FIG. 15) may be used at the longitudinal ends 151 of the drain body 102, and a floor termination 104C having a vertical component may be used at the longitudinal ends 151 of the drain body 102 adjacent a wall or other vertical structure (e.g., a curb entrance to a shower). In other words, any of the end attachments 104 can be selectively attached to the longitudinal ends 151 of the drain body 102 and/or each other, depending upon the needs of the installer during installation of the assembly 100. Moreover, because of the constant outer cross-section profile of the drain body 102 between the longitudinal ends 151 of the drain body 102 and the outlet structure 106, the position of the longitudinal ends 151 can be altered, making the assembly 100 customizable to fit almost any design space. The constant outer cross-sectional profile of the drain body 102 can be defined by the bottom surface 114 and the side walls 116. The constant outer cross-sectional profile of the drain body 102 can be defined by the bottom surface, the side walls 116, and the bottom surface of the flanges 142. The constant outer cross-sectional profile can be defined by the side walls 116.

Preferably, although not necessarily, the drain body 102 and end attachments 104 are made of a polymeric material (e.g., ABS) and secured and sealed to one another with a polymeric material adhesive (e.g., ABS adhesive).

Figure 15:
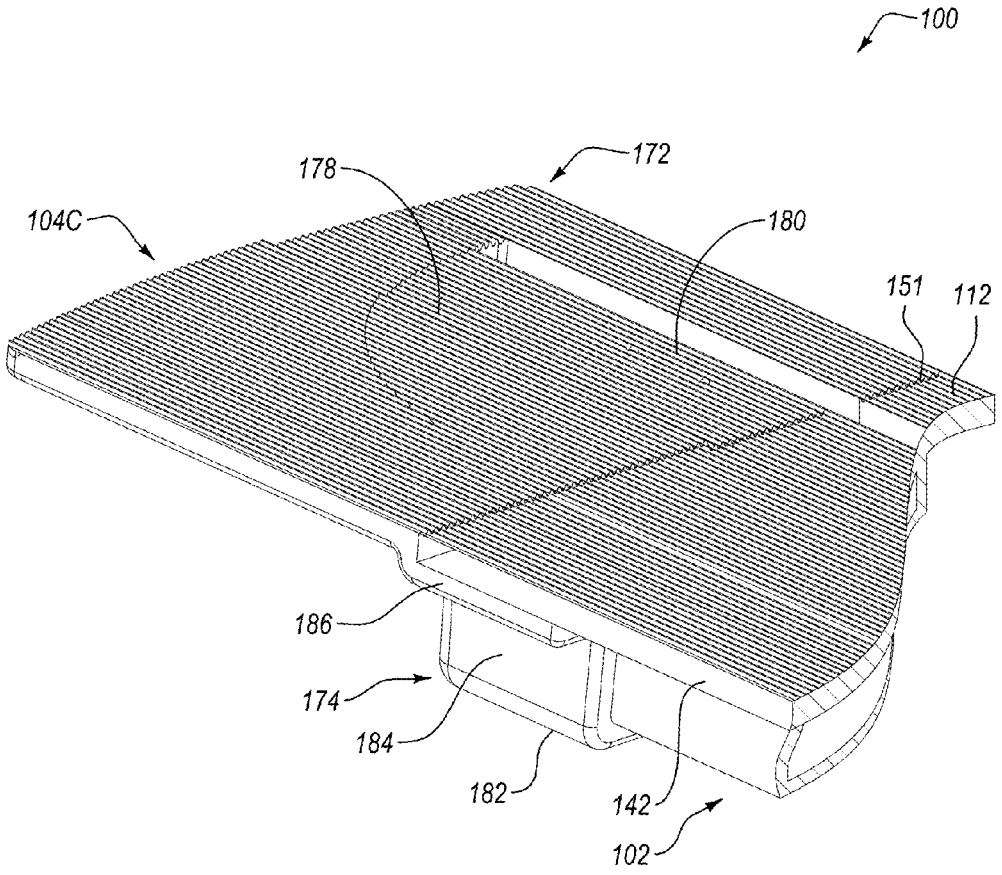
FIG. 15 is an isometric view of a floor termination attached to the drain body according to an embodiment.
Figure 16:
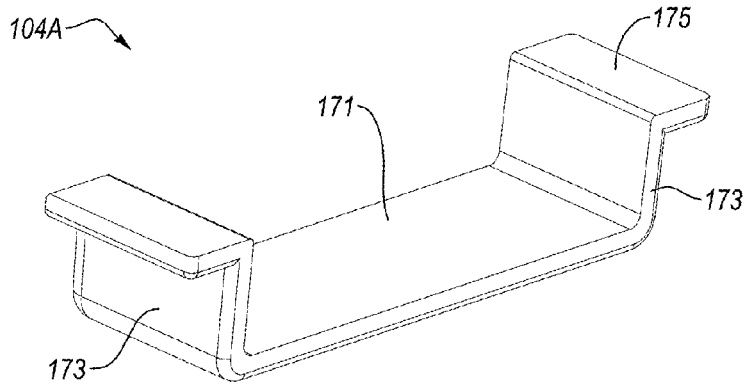
FIG. 16 is an isometric view of a coupling according to an embodiment.

FIG. 15 illustrates a floor termination 104C for allowing the assembly 100 to terminate at any point within a floor. The floor termination 104C includes a body portion 172 and an attachment portion 174. Many of the features of the body portion 172 may be similar to the drain body 102, including an internal channel 176 (shown in FIG. 24), a permanent structural cover 178 (including a low-profile bondable top surface) covering the internal channel 176, and a slotted inlet 180 that extends longitudinally and is in in fluid communication with the internal channel 176. The slotted inlet 180 can align with and/or form a continuation of the slotted inlet 112. The internal channel 176 can align with and/or form a continuation of the internal channel 108. The body portion 172 may have a curved longitudinal end or a linear longitudinal end opposite the attachment portion 174.

The attachment portion 174 may include many of the features of the coupling 104A, having a generally U-shaped including a bottom wall 182, side walls 184 extending upward from the bottom wall 182, and flanges 186 extending horizontally from the top of the side walls 184. Alternatively, the attachment portion 174 may not include flanges or may have a different shape.

When a longitudinal end 151 of the drain body 102 and the body portion 172 of the floor termination 104C are positioned end to end, the attachment portion 174 attaches to the outer cross-sectional profile of the drain body 102. The bottom wall 182, side walls 184 and flanges 186 span a joint formed between the drain body 102 and the body portion 172 of the floor termination 104C which abut one another in an end-to-end to manner. The bottom wall 182 underlaps the internal channel 108 and the flanges 186 underlap the flanges 142 of the drain body 102. In coupling the floor termination 104C to the drain body 102, the internal channel 176 of the floor termination 104C and the internal channel 108 of the drain body 102 can be substantially aligned and sloping downwardly in the same direction. The slotted inlet 180 can be aligned with the slotted inlet 112. The drain body 102 can thus be cut transversely through the drain body 102 between the longitudinal ends 151 and the outlet structure 106, with the floor termination 104C enclosing the end of the internal channel 108.

To help with the above described functionality, the assembly 100 can include a coupling 104A (shown in FIG. 16) to join adjacent drain bodies 102 and/or a drain body 102 to a drain extension. With respect to the coupling, it can be generally U-shaped having a bottom wall 171, side walls 173 extending vertically upward from the bottom wall, and flanges 175 extending horizontally from the top of the side walls 173.

The bottom wall 171, side walls 173, and flanges 175 can span a joint formed between the drain body 102 and the extension which abut one another in an end-to-end manner. The bottom wall 171 underlaps the internal channel 108 and the flanges 175 can underlap the flanges 142 of the drain body 102 and the flanges of the extension (if any). The coupling 104A thus attaches to the respective undersides of the drain body 102 and the extension, and further spans the two. Thus, the drain assembly 100 can optionally be lengthened by coupling the drain body 102 and extension together in an end-to-end fashion using the coupling.

The extension member can include many of the same features of the drain body 102 between the longitudinal ends 151 of the outlet structure 106, including a permanent cover, an internal channel, a slotted inlet, a drip edge, and a constant outer cross section profile. In coupling the extension to the drain body 102, the internal channel of the extension and the internal channel 108 of the drain body 102 can be substantially aligned and sloping downwardly in the same direction. The internal channel of the extension may be similar to the internal channel 108, including, for example, an entrance flow region and a main flow region. Alternatively, the internal channel of the extension may be different than the internal channel 108. For instance, the internal channel of the extension member 104B may be oversized for increased capacity. Thus, coupling 104A can be used to attach the extension to the drain body 102 to form a longer assembly 100, having a continuous internal channel between the two separate members.

Figure 17:
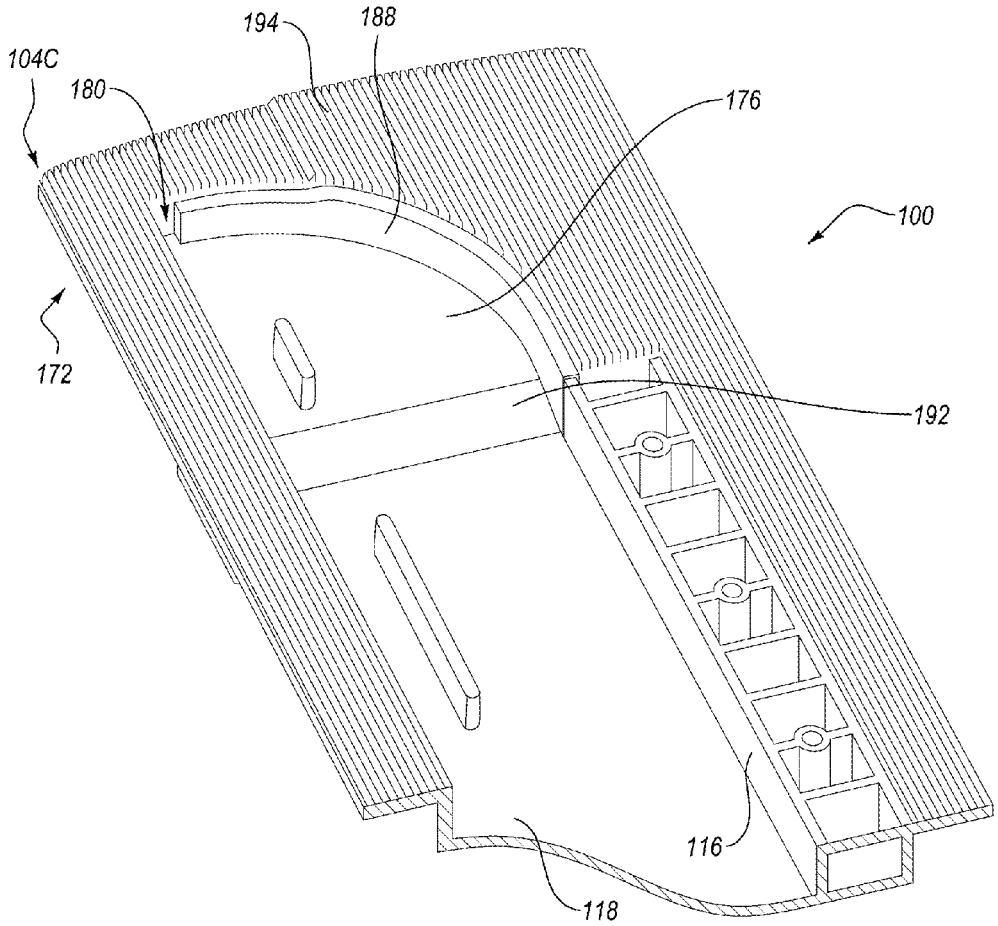
FIG. 17 is a top isometric view of the floor termination and drain body shown in FIG. 15 according to an embodiment.
Figure 18:
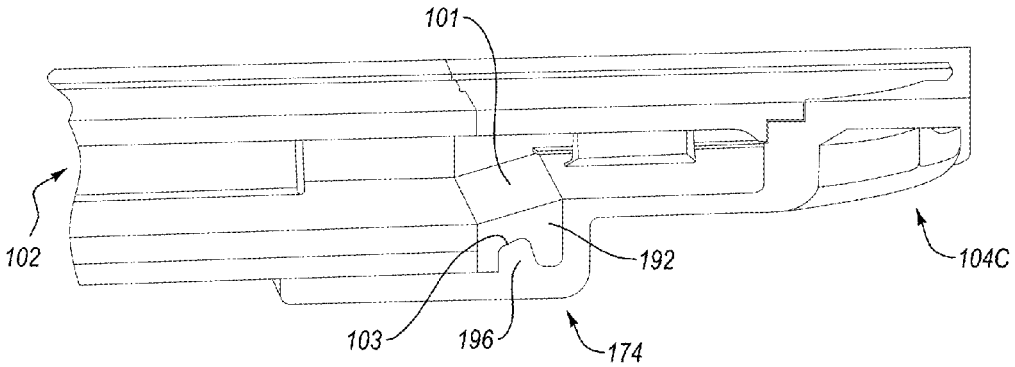
FIG. 18 is a cross-sectional view of the floor termination and drain body shown in FIG. 15 according to another embodiment.

FIG. 17 shows the floor termination 104C with the cover removed for ease of reference according to an embodiment. As shown, the internal channel 176 within the body portion 172 can include a curved or swept end 188 that sweeps toward the slotted inlet 180. This has the effect of making the assembly 100 easier to clean. For instance, a brush may be adapted to be received within the main flow region, through the access hole of the drain body. The brush can then be advanced longitudinally along the side wall surface and bottom surface 118 toward the floor termination 104C. As the brush and any debris collected by the brush enter the floor termination 104C, the swept end 188 of the internal channel 176 can direct the brush and debris toward the slotted inlet 180, through which the debris can be cleaned out of the assembly 100. In other embodiments, the brush may include a grip or handle at both ends of an elongated body. The grips or handles may allow the brush to be moved in alternating directions within the internal assembly 100 to facilitate further sweeping of debris or mechanical cleaning (i.e., scrubbing) of the surfaces of the internal channel.

As shown in FIG. 17, the floor termination 104C can include ramp 192 or inclined surface extending between the bottom surface 118 and the bottom surface of the internal channel 176. This advantageously can eliminate a non-accessible vertical step between the internal channel 176 and the internal channel 108 that could collect debris. It will be appreciated that the top surface of the cover 178 can include many of the same features as the cover 110, including, longitudinal grooves 194, a three-dimensional lock, and a tile trim seat. Thus, the floor termination 104C provides a bondable and/or sealable surface for top surface waterproofing and can have tile extending thereover.

The attachment portion 174 can include a protrusion 196 extending between the side walls 184. The floor termination 104C may also include one or more interchangeable transition ramps 192 having a top inclined surface 101 and a bottom surface with a recess 103 generally corresponding to the protrusion 196. The one or more ramps 192 may be interchangeable and each may include a different height or slope. The transition ramps 192 may be selectively attached to the protrusion 196 by placing the recess 103 over the protrusion 196 and gluing the ramp 192 to the protrusion 196. This can have the effect of providing a smooth transition or small step between the bottom surfaces of the internal channel 176 and the internal channel 108. The ramps 192 may be installed before the floor termination 104C is glued to the drain body 102. This advantageously has the effect of eliminating major steps that could be formed between the internal channels 108, 176, depending on where the drain body 102 is cut. The bottom surface 118 of the internal channel 108 may include markings indicating which ramp 192 should be used within specific zones or areas along the length of the drain body 102.

Figure 19:
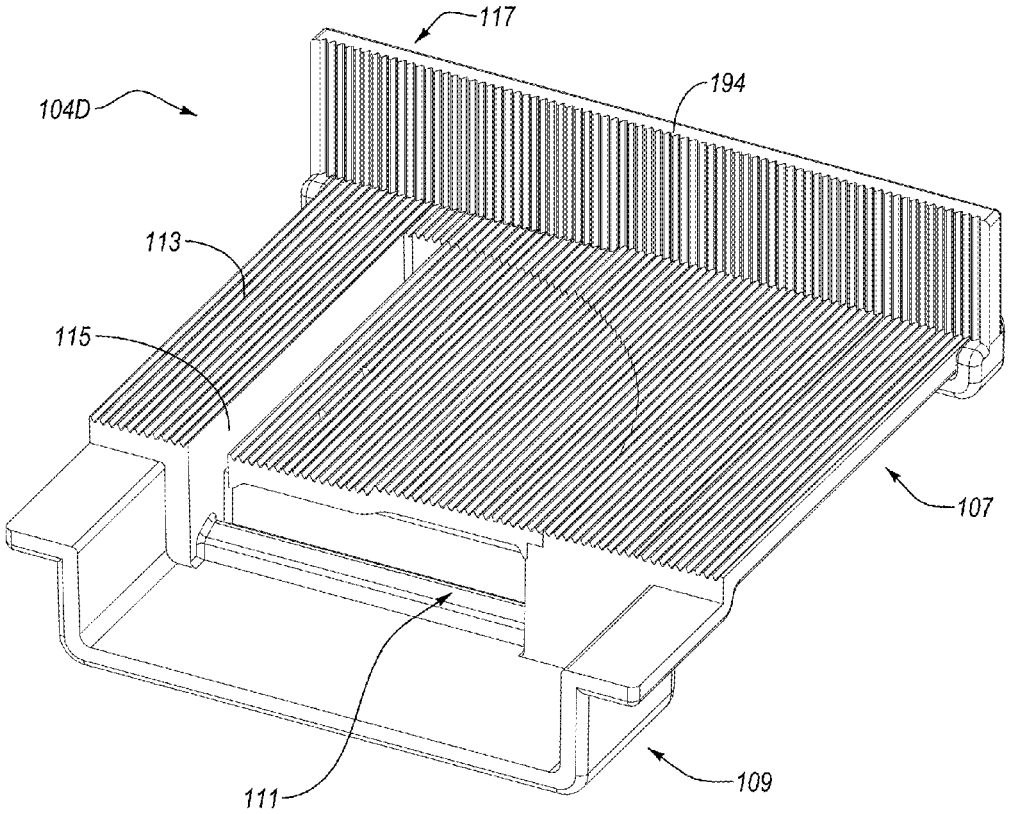
FIG. 19 is an isometric view of a wall transition according to an embodiment.

FIG. 19 illustrates a wall termination 104D for allowing the assembly 100 to terminate at a wall or extend from wall to wall. The wall termination 104D includes a body portion 107 and an attachment portion 109. The attachment portion 109 may be the same as the attachment portion 174 and may attach to the drain body 102 in the same or substantially the same manner. The body portion 107 may be similar to the body portion 172, including an internal channel 111, a permanent structural cover 113 (including a low-profile bondable top surface) covering the internal channel 111, and a slotted inlet 115 that extends longitudinally and is in in fluid communication with the internal channel 111.

The body portion 107 may have a rectangular longitudinal end opposite the attachment portion 109. The body portion 172 may further include a substantially vertical end wall 117 extending upward from the cover 113. The end wall 117 may be attached to a wall framing structure or a waterproof panel on a wall (such as backer board used on a shower wall to which shower wall tiles can be directly or indirectly affixed). In an embodiment, the end wall 117 may be positioned in a notch formed in the backer board. The end wall 117 also includes a bondable and/or sealable surface for waterproofing. For instance, the inner surface of the end wall 117 can include a plurality of grooves 194. The end wall 117 can thus provide a waterproof seal between the assembly 100 and the associated surrounding structure (i.e., backer board).

When wall terminations 104D are used on both longitudinal ends 151 of the drain body 102, the assembly 100 can run from wall-to-wall in a shower. The drain body 102 can thus be cut transversely through the drain body 102 between the longitudinal ends 151 and the outlet structure 106, with the wall transitions 104D enclosing the ends of the internal channel 108 and extending the assembly 100 from wall to wall.

In another embodiment, the wall termination 104D can comprise an attachment that attaches to a floor termination member 104C to convert the floor termination member 104C to a wall termination member. The wall termination 104D can comprise an attachment portion connected to a body portion comprising a vertical end wall. The attachment portion can be sized and configured to connect to the longitudinal end of the floor termination member 104C. Like the end wall 117, the vertical end wall of the body portion may be generally vertical and may be attached to a wall framing structure or a waterproof panel on a wall (such as backer board used on a shower wall to which shower wall tiles can be directly or indirectly affixed. The end wall can include a bondable and/or sealable surface for waterproofing. For instance, the end wall can include a plurality of vertical grooves and a mesh material, similar to the grooves and mesh material described in relation to FIGS. 9 and 10. The end wall can thus provide a substantially waterproof seal between the assembly 100 and the associated surrounding structure. When wall terminations 104D are used on both longitudinal ends 151 of the drain body 102, the assembly 100 can run from wall-to-wall in a shower.

FIGS. 20-24 illustrate a linear drain assembly 400 according to another embodiment. The assembly 400 includes many of the same components and features as the assembly 100 shown in FIGS. 1-19. Components of the assembly 400 that are identical or similar to each other have been provided with the same or similar reference numerals, and an explanation of their structure and function will not be repeated unless the components function differently in the assemblies. However, it should be noted that the principles of the assembly 400 can be employed with any of the embodiments described with respect to FIGS. 1-19 and vice versa.

Figure 20:
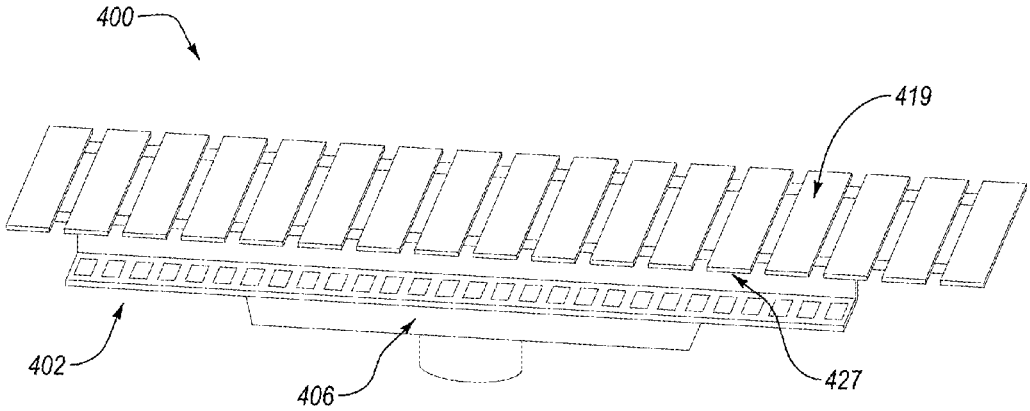
FIG. 20 is an isometric view of a linear drain assembly according to another embodiment.
Figure 21:
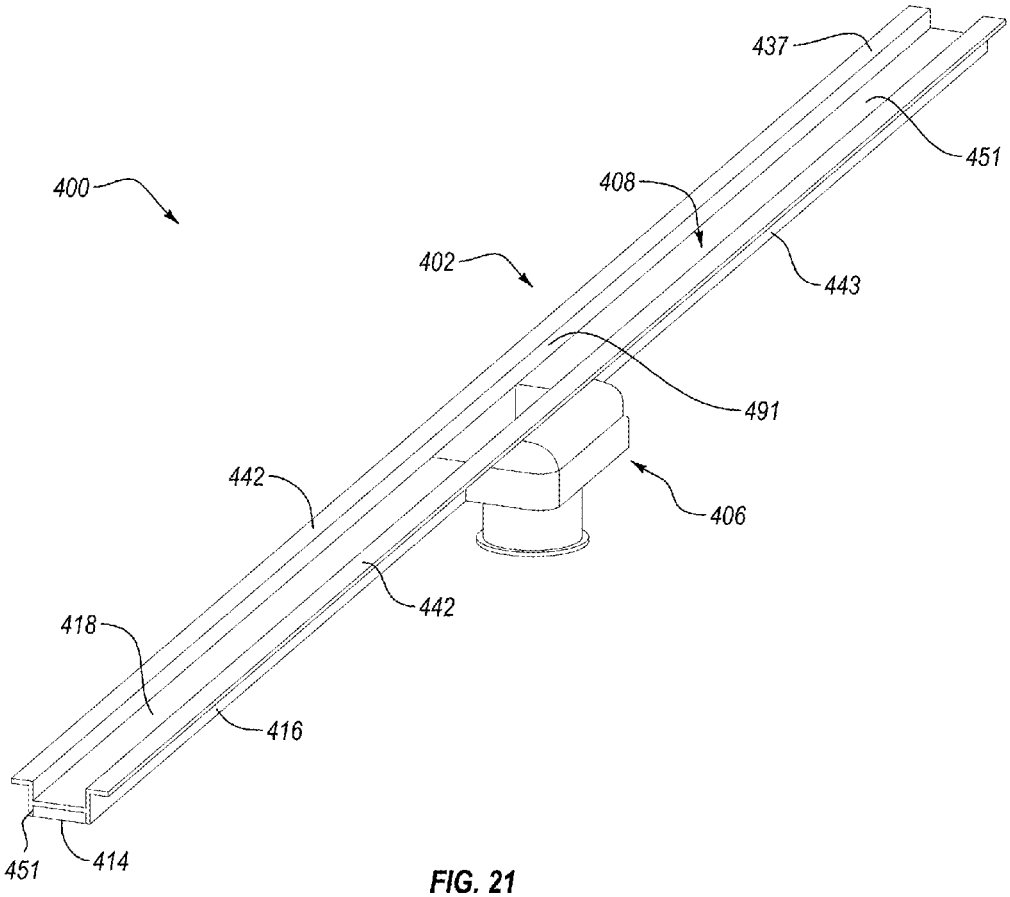
FIG. 21 is an isometric view of a drain body according to an embodiment.

Referring to FIGS. 20 and 21, the assembly 400 can include at least one drain body 402 and at least one end attachment 404A (shown in FIG. 24) that is selectively attachable to the drain body 402. The drain body 402 includes an outlet structure 406 and a drain channel 408 that intercepts the outlet structure 406. The drain body 402 between the outlet structure 406 and the longitudinal ends 451 of the drain body 402 can exhibit a U-shaped outer cross-section having a bottom surface 414 and side walls 416 extending generally upward from the bottom surface 414, and flanges 442 extending horizontally from the side walls 416. The bottom surface 414 can be substantially flat. A portion of the bottom surface 414 and the side walls 416 can merge with and/or form a part of the outlet structure 406.

Like the top surface of the cover 110, the top surface of the flanges 442 can be bondable and/or sealable for waterproofing. For instance, the top surface of the flanges 442 can include a plurality of longitudinal grooves 443 and/or an encapsulated mesh material attached thereto. The assembly 400 includes a removable grate rather than the permanent structural cover for covering the drain channel 408.

The drain channel 408 can run from one longitudinal end 451 of the drain body 402 to the other longitudinal end 451 of the drain body 402, being intercepted by an outlet structure 406. The drain channel 408 is open facing upwards and includes a generally U-shaped cross-section including a bottom wall 418 defining a bottom surface 418, side walls 491 extending generally vertically upwardly from the bottom wall 418, and flanges 442 extending horizontally from the top of the side walls 416. The drain channel 408 can be linear and can be sloped downwardly toward the outlet structure 406. Like the drain body 102, the drain body 402 may include an outer cross-sectional profile that is constant between the longitudinal ends 451 and the outlet structure 406.

Figure 22:
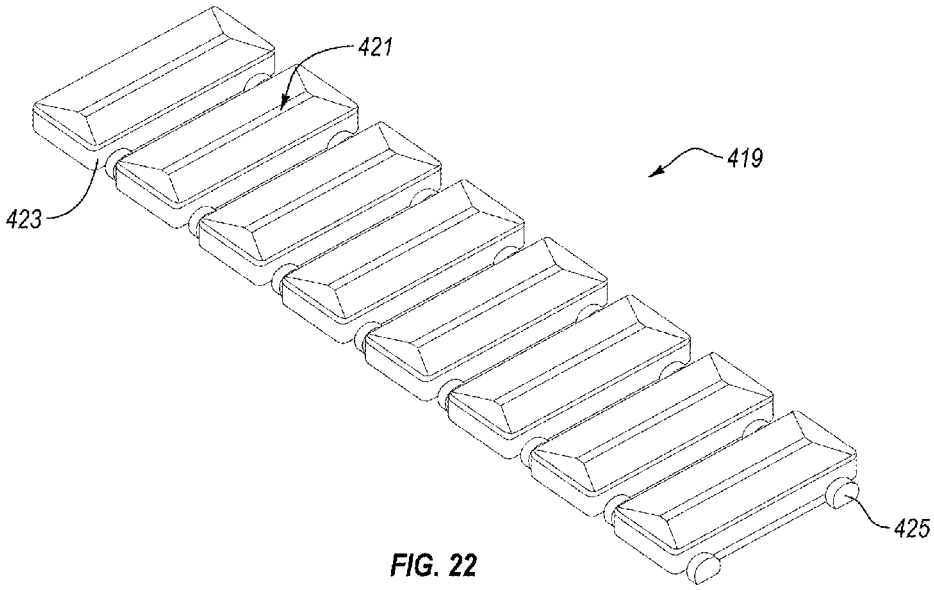
FIG. 22 is an isometric view of a grate according to an embodiment.

To protect the drain channel 408, the assembly 100 includes a plurality of removable grates 419. As shown in FIGS. 20 and 22, the grates 419 can be positioned end to end over the top of the drain channel 408 and can include one or more openings in fluid communication with the drain channel 408. The grates 419 can include a plurality of plates 421 and openings extending between a pair of support rails 423. The grates 419 can include spacers 425 or stops on the longitudinal ends of each grate 419 for maintaining spacing between adjacent grates.

The grates 419 can extend along substantially or the entire length of the drain channel 408. The grates 419 may exhibit any suitable configuration. The grates 419 may be made from plastic (e.g., ABS), metal, and/or may be chrome plated.

Figure 23:
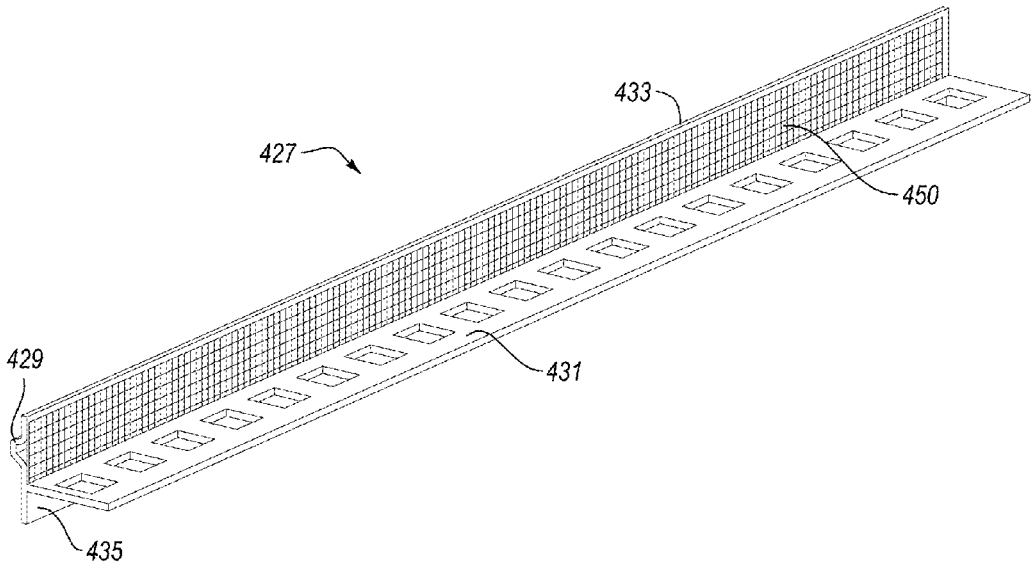
FIG. 23 is an isometric view of a support rail according to an embodiment.

As seen in FIGS. 20 and 23, support rails 427 are provided with ridges 429 to support the grates 419 over the drain channel 408. The support rails 427 can be generally T-shaped, including a first portion 431 that rests on the flange 442 of the drain body 402, a second generally upright portion 433 forming the edge against which tile can rest and supporting the grates 419, and a third generally upright portion 435 extending downward into the drain channel 408. The ridge 429 can extend longitudinally along the inside of the second portion 433.

Similar to the cover 110, the support rails 427 may be configured to form a three-dimensional lock to help capture bonding or other materials for waterproofing. The support rails 427 can include an encapsulated mesh material 450 attached to the face of the second portion 433. In addition, one or more surfaces of the support rails 427 can be textured to increase the bonding or sealable area on the support rails 427. The support rails 427 can be made from metal and/or plastic. A plurality support rails 427 may extend along each side of the drain channel 408. One or more short support rails 427 may be configured to transverse the drain channel 408.

The drain channel 408 may include an integral support 437 for supporting the support rails 427 within the drain channel 408. The integral support 437 can be a longitudinal recessed surface formed in the side walls of the drain channel 408. The recessed surface can form a support surface upon which the bottom of the third portion 435 of the support rails 427 can rest.

Similar to the assembly 100, the outer cross-sectional profile of the drain body 402 remains constant or substantially constant from at least one of the longitudinal ends 451 of the drain body 402 to the outlet structure 406 and can be made from ABS, PVC, or any other suitable material. This allows the length of the assembly 400 to be altered onsite by an installer using commonly available tools. End attachments 404 can be selectively attached to the outer surface of the drain body 402. Consequently, the assembly 400 can be cut to precise lengths and the end attachments 404 can be attached to almost any location where the drain body 402 is cut.

Figure 24:
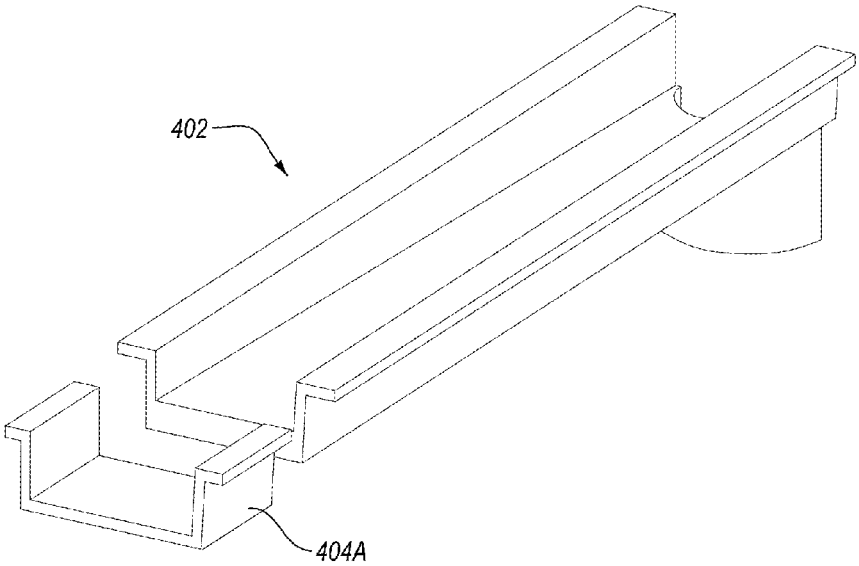
FIG. 24 is an isometric view of a coupling and drain body according to an embodiment.

Many of the features of the end attachments 104, are also applicable to the assembly 400, including a coupling 404A, an extension, a floor termination 404C, and a wall transition 404D. FIG. 24 illustrates the coupling 404A being attached to a longitudinal end of the drain body 404. The coupling 404A can be configured similarly to the coupling previously discussed and attached to the drain body 402 in the same or similar manner. Like the wall transition 104D, a wall transition can include a sealable and/or bondable upright surface that permits the assembly 400 to extend from wall to wall in a shower.

It will be appreciated that the linear drain assemblies described herein are to be regarded as exemplary only, as any appropriate linear drain assemblies are possible. For instance, the linear drain assemblies of the present disclosure can be a drain for a pool, a sink, or any other suitable wet area. In an alternative embodiment, the linear drain assemblies may be curved rather than linear. In addition, the linear drain assemblies can comprise square drains, round drains, standard drains, or any other suitable type of drain. Moreover, the linear drain assemblies of the present disclosure can be installed into a variety of shower pan and mortar bed options including, but not limited to, copper, CPE, PVC, lead, and hot tar pans. In addition, the drain channels of the linear drain assemblies of the present disclosure may be flat or may have cross-sectional shapes that vary along the length of the drain channel. In other embodiments, the grooves in the top surface can extend diagonally, laterally, or along one or more curved paths. In yet other embodiments, the mesh material may form a grid, a network, a cross-hatch, a web, combinations thereof, or any other suitable pattern. The mesh material may further a plurality of layers. For instance, one mesh material may be positioned on top of another mesh material to control the pattern and/or size of the through holes in communication with the grooves. In other embodiments, the drain body may include more than one outlet structure and/or the outlet structure may extend from the side of the drain body. In yet other embodiments, the end attachments may be integral to the drain body and/or the end attachments may be omitted. In alternative embodiments, one or more features of the present disclosure can be included in standard drain systems (e.g., square drains or round drains).

The articles "a," "an," and "the" are intended to mean that there are one or more of the elements in the preceding descriptions. The terms "comprising," "including," and "having" are intended to be inclusive and mean that there may be additional elements other than the listed elements. Additionally, it should be understood that references to "one embodiment" or "an embodiment" of the present disclosure are not intended to be interpreted as excluding the existence of additional embodiments that also incorporate the recited features. Numbers, percentages, ratios, or other values stated herein are intended to include that value, and also other values that are "about" or "approximately" the stated value, as would be appreciated by one of ordinary skill in the art encompassed by embodiments of the present disclosure. A stated value should therefore be interpreted broadly enough to encompass values that are at least close enough to the stated value to perform a desired function or achieve a desired result. The stated values include at least the variation to be expected in a suitable manufacturing or production process, and may include values that are within 5%, within 1%, within 0.1/%, or within 0.01% of a stated value.

A person having ordinary skill in the art should realize in view of the present disclosure that equivalent constructions do not depart from the spirit and scope of the present disclosure, and that various changes, substitutions, and alterations may be made to embodiments disclosed herein without departing from the spirit and scope of the present disclosure. Equivalent constructions, including functional "means-plus-function" clauses are intended to cover the structures described herein as performing the recited function, including both structural equivalents that operate in the same manner, and equivalent structures that provide the same function. Any element of an embodiment described herein may be combined with any element of any other embodiment described herein. It is the express intention of the applicant not to invoke means-plus-function or other functional claiming for any claim except for those in which the words 'means for' appear together with an associated function. Each addition, deletion, and modification to the embodiments that falls within the meaning and scope of the claims is to be embraced by the claims.

The terms "approximately," "about," and "substantially" as used herein represent an amount close to the stated amount that still performs a desired function or achieves a desired result. For example, the terms "approximately," "about," and "substantially" may refer to an amount that is within less than 5% of, within less than 1% of, within less than 0.1% of, and within less than 0.01% of a stated amount. Further, it should be understood that any directions or reference frames in the preceding description are merely relative directions or movements. For example, any references to "forward" and "rearward" or "above" or "below" are merely descriptive of the relative position or movement of the related elements.

The present disclosure may be embodied in other specific forms without departing from its spirit or characteristics. The described embodiments are to be considered as illustrative and not restrictive. The scope of the disclosure is, therefore, indicated by the appended claims rather than by the foregoing description. Changes that come within the meaning and range of equivalency of the claims are to be embraced within their scope.

What is claimed is:

1. A linear drain assembly comprising:

a drain body including:

a permanent structural cover:

a first drain channel formed below the cover and extending in a longitudinal direction along the drain body;

a first slotted inlet defined in the cover and located toward a sidewall of the first drain channel, the first slotted inlet extending in the longitudinal direction along the cover and being in fluid communication with the first drain channel; and an outlet structure intercepting the drain channel; and at least one end attachment attachable to a longitudinal end of the drain body, the at least one end attachment including;

a second drain channel in fluid communication with the first drain channel of the drain body, the second drain channel having a closed end defining a curvature; and a second slotted inlet extending in the longitudinal direction along the at least one end attachment and in fluid communication with the second drain inlet, the second slotted inlet forming a continuation of the first slotted channel, wherein the closed end of the second drain channel is arranged to direct debris moving through the second drain channel toward the second slotted inlet.

2. The assembly of claim 1 further comprising at least one flow structure removably positioned in the outlet structure, the at least one flow structure forming a plurality of indirect flow paths within the outlet structure such that water flowing through the at least one flow structure is dispersed or flow time through the outlet structure is lengthened, decreasing kinetic energy or noise associated with the water.

3. The assembly of claim 2, wherein the at least one flow structure further forms one or more escape paths through which at least one of air or gases trapped within the outlet structure can flow.

4. The assembly of claim 1, wherein an upper surface of the first drain channel defines a recessed portion extending longitudinally and forming a slope along the upper surface.

5. The assembly of claim 1, wherein the at least one end attachment includes a second permanent structural cover covering the second drain channel, the second slotted inlet being defined in the second cover.

6. The assembly of claim 1, further comprising a removable panel formed in the cover, the removable panel arranged to be attached to a tile and selectively hidden below a tile floor.

7. The assembly of claim 1, wherein the cover defines a tile trim seat extending longitudinally along a length of the drain channel and arranged for receiving and positioning a tile trim.

8. The assembly of claim 1, wherein the cover defines a plurality of longitudinal grooves and a mesh material attached over the top of the grooves.

* * * * *